US006283385B1

(12) United States Patent
Beaver et al.

(10) Patent No.: US 6,283,385 B1
(45) Date of Patent: Sep. 4, 2001

(54) METHOD AND APPARATUS FOR DISPENSING MULTIPLE-COMPONENT FLOWABLE SUBSTANCES

(75) Inventors: Larry Gene Beaver, Lake Park; Edward Francis Nichenko, Hahira, both of GA (US); Mark T. MacLean-Blevins, Westminster, MD (US)

(73) Assignee: Griffin LLC, Valdosta, GA (US)

( * ) Notice: Subject to any disclaimer, the term of this patent is extended or adjusted under 35 U.S.C. 154(b) by 0 days.

(21) Appl. No.: 09/236,142

(22) Filed: Jan. 22, 1999

(51) Int. Cl.[7] ..... B05B 7/26

(52) U.S. Cl. ..... 239/10; 239/310; 239/315; 239/316; 239/318

(58) Field of Search ..... 239/310, 315, 239/316, 318, 10

(56) References Cited

U.S. PATENT DOCUMENTS

D. 356,026 * 3/1995 Iaia et al. .
2,246,211 * 6/1941 Kilich ..... 239/318 X
2,302,799 * 11/1942 Peterson ..... 239/310 X
2,646,063 7/1953 Hayes .
2,719,704 * 10/1955 Anderson et al. ..... 239/318 X
2,965,309 * 12/1960 Parrott ..... 239/310
3,104,813 9/1963 Baatrup .
3,104,825 9/1963 Hayes .
3,106,347 10/1963 Hayes .
3,181,797 5/1965 Hayes .
3,201,049 8/1965 Hayes .
3,381,899 5/1968 Forsman .
4,057,505 11/1977 Nakagawa et al. .
4,071,463 1/1978 Steinhauer .
4,113,645 9/1978 DeSimone .
4,116,851 9/1978 Rupe et al. .
4,355,739 * 10/1982 Vierkotter .
4,489,890 * 12/1984 Martin .
4,527,741 * 7/1985 Garneau .
4,570,856 2/1986 Groth et al. .
4,618,077 * 10/1986 Corsette .
4,747,523 * 5/1988 Dobbs .
4,789,495 12/1988 Cahall et al. .
4,801,046 * 1/1989 Miczka .
4,806,263 2/1989 Leathers et al. .
4,964,539 * 10/1990 Mueller .
5,009,342 * 4/1991 Lawrence et al. .
5,039,016 8/1991 Gunzel, Jr. et al. .
5,052,590 * 10/1991 Ratcliff .
5,071,070 * 12/1991 Hardy ..... 239/318 X
5,100,059 3/1992 Englhard et al. .
5,143,261 * 9/1992 Drobish .
5,152,461 * 10/1992 Proctor .
5,213,265 5/1993 Englhard et al. .
5,223,168 6/1993 Holt .

(List continued on next page.)

OTHER PUBLICATIONS

Green Garden, Inc., Lawn & Garden Accessories, "Hose End Sprayers," brochure, 4 pages.
Five pages of photocopy of bottle of Armor All E–Z Spray Window Wash.

*Primary Examiner*—Andres Kashnikow
*Assistant Examiner*—Robin O. Evans
(74) *Attorney, Agent, or Firm*—Kilpatrick Stockton LLP

(57) ABSTRACT

There is disclosed a sprayer apparatus for selectively spraying or dispensing multiple fluid components. The apparatus comprises a housing having a first inlet and an first outlet, the first housing inlet being adapted for attachment to a garden hose, the first housing outlet being in fluid communication with the first housing inlet; and an insert member having a first inlet for receiving fluid and a first outlet for dispensing fluid therefrom, the first insert inlet being in fluid communication with the first insert outlet through a passage defined by the insert member, the insert member being mateable with the housing so that the first housing outlet mates with the first insert inlet so that a fluid can flow from the first housing inlet to the first insert outlet. A method of spraying a fluid is also disclosed.

36 Claims, 17 Drawing Sheets

U.S. PATENT DOCUMENTS 5,290,470 3/1994 Dutcher .
5,320,288 * 6/1994 Ketcham, Jr. .
5,332,157 * 7/1994 Proctor .
5,370,275 * 12/1994 Mills et al. .
5,376,296 * 12/1994 Dutcher .
5,383,603 1/1995 Englhard et al. .
5,385,270 * 1/1995 Cataneo et al. .
5,398,846 * 3/1995 Corba et al. .
5,402,916 * 4/1995 Nottingham et al. .
5,433,350 * 7/1995 Graubart .
5,439,141 * 8/1995 Clark et al. .
5,467,900 * 11/1995 Maas et al. .
5,472,119 * 12/1995 Park et al. .
5,535,950 * 7/1996 Barriac et al. .
5,544,810 * 8/1996 Horvath, Jr. et al. ..... 239/310 X
5,560,545 * 10/1996 Grogan et al. .
5,562,250 * 10/1996 O'Neill .
5,564,600 * 10/1996 Renault .
5,566,860 * 10/1996 Schiltz et al. .
5,567,247 10/1996 Hawes et al. .
5,586,695 * 12/1996 Labus et al. .
5,595,345 * 1/1997 Chura et al. .
5,605,578 2/1997 Hawes et al. .
5,626,259 * 5/1997 Maas et al. .
5,676,280 * 10/1997 Robinson .
5,676,282 * 10/1997 Satterfield .
5,713,519 * 2/1998 Sandison et al. .
5,735,422 * 4/1998 Binter .
5,906,319 * 5/1999 Crowl ..... 239/318 X

* cited by examiner

METHOD AND APPARATUS FOR DISPENSING MULTIPLE-COMPONENT FLOWABLE SUBSTANCES

FIELD OF INVENTION

The present invention relates generally to dispensing apparatus, and, more specifically, to dispensing apparatus for dispensing multiple-component flowable substances, either individually or in combination. The present invention also relates to a method of dispensing flowable substances.

BACKGROUND OF THE INVENTION

Sprayers and dispensers for mixing and dispensing liquids into a carrier fluid, such as water, are disclosed in U.S. Pat. Nos. 5,152,461; 5,320,288; 5,385,270; 5,398,846; 5,402,916; 5,595,345; 5,605,578; and 5,713,519. Such sprayers typically include an inlet for a hose, such as a garden hose, and an inlet for a siphon tube for removing products from a container attached to the sprayer. The sprayers and dispensers typically spray a water/product mixture, or water only, through one or more horizontally or vertically arranged outlets of the sprayer.

Some sprayers or dispensers that include a positive "trigger" pump include two separate containers of product(s) for dispensing those product(s) from the sprayer, but do not have any means of connection to a carrier fluid for instantaneous dilution and the products dispensed must be diluted at the factory to ready-to-use concentration so a high percentage of weight and volume formulated is water, thereby causing users to buy four to fifty times more weight and volume of finished goods than they would otherwise need to achieve the same kind of uniform and broad coverage. Also, these sprayers cannot be used comfortably to treat anything but the smallest surface areas. These prior art sprayers and dispensers are often difficult to assemble and to use and do not always dispense product as desired or ergonomically. Furthermore, with some sprayers it is difficult or impossible to control product dilution ratios and to provide relatively large or small dilution ratios at relatively low flow rates. For those prior art sprayers that use a venturi to draw product into a flowing stream of diluent, in order to achieve relatively low dilution ratios, it is necessary to employ relatively high flow rates.

In conventional sprayers that use an aspirator to draw fluid from a container into a flowing stream of diluting fluid, there is a requirement that the outlet passage be of greater diameter than the inlet passage so as to produce a low pressure area within the portion of greater diameter. U.S. Pat. No. 5,595,345 specifically teaches that in an aspirated system, the downstream portion must have a larger cross-sectional area than the upstream portion. These design parameters however limit the ability to provide a wide range of dilution ratios at widely varying flow rates and to provide fixed dilution ratios that are independent of bulk fluid flow.

Thus, a need exists for a sprayer that dispenses a multiple-part concentrated product efficiently and effectively, is relatively easy to assemble and use, has variable dilution ratios and also can achieve a relatively wide range of dilution ratios at relatively low flow rates. Furthermore, there is a need for a dispenser that can sequentially dispense separate components or multiple components incompatible upon storage or can dispense the same component at different dilution ratios. Additionally, there is a need for an apparatus that can dispense or reintroduce to a diluent stream components that were removed or inadvertently filtered from a primary product stream or to introduce additional therapeutic components.

SUMMARY OF THE INVENTION

The present invention satisfies the above-described needs by providing an apparatus comprising a sprayer having an inlet and an outlet, the inlet being adapted for attachment to a garden hose and a container for containing a concentrated product for spraying from the outlet of the sprayer after dilution with water from the garden hose. The container has an upwardly extending handle and the sprayer has downwardly extending flanges for engaging a portion of the upwardly extending handle, so that when the sprayer is attached to the container and the flanges engage the handle the sprayer is aligned with the container such that the outlet is distal with respect to the handle.

In another embodiment of the present invention, an apparatus is provided comprising a sprayer having an inlet and an outlet, the inlet being adapted for attachment to a garden hose and a base adapted for attachment to the sprayer and for containing a concentrated product for spraying from the outlet of the sprayer after dilution with water from the garden hose. The base comprises a first container and a second container. The first container has an outwardly projecting first locking member and the second container defines a first recess for receiving and mating with the first locking member, such that when the first locking member is received in the first recess, the first and second containers resist transverse separation and twisting separation with respect to each other.

In another embodiment of the present invention, an apparatus is provided comprising a sprayer having an inlet and an outlet, the inlet being adapted for attachment to a garden hose and a container for containing a concentrated product for spraying from the outlet of the sprayer after dilution with water from the garden hose, the container having an upwardly extending handle, such that when the container is attached to the sprayer, the handle is disposed below the inlet.

In another embodiment of the present invention, an apparatus is provided comprising a sprayer having an inlet and a first and second outlet, the inlet being adapted for attachment to a garden hose, and a base for containing a concentrated product for spraying from at least one of the outlets of the sprayer after dilution with water from the garden hose. The first and second outlets are disposed transverse with respect to the sprayer and laterally spaced from each other.

In another embodiment of the present invention, there is disclosed an apparatus comprising a housing having a first inlet and an first outlet, the first housing inlet being adapted for attachment to a garden hose, the first housing outlet being in fluid communication with the first housing inlet. The apparatus also comprises an insert member having a first inlet for receiving fluid and a first outlet for spraying fluid therefrom, the first insert inlet being in fluid communication with the first insert outlet through a passage defined by the insert member, the insert member being mateable with the housing so that the first housing outlet mates with the first insert inlet so that a fluid can flow from the first housing inlet to the first insert outlet.

In another embodiment of the present invention, there is disclosed an apparatus comprising a housing, the housing defining a first fluid passage from an inlet to an outlet, the first fluid passage including a first portion and a second portion, the first portion having a longitudinal axis that is at an acute angle with respect to the longitudinal access of the second portion. The housing further defining a second fluid passage from an inlet to an outlet, the second fluid passage intersecting the second portion of the first fluid passage adjacent the first portion such that fluid flowing through the first passage draws fluid in the second passage into the first passage.

In another embodiment of the present invention, there is disclosed a method of spraying a two-component diluted product. The method comprises attaching an inlet of a sprayer to a source of flowing water; the sprayer also having a first and second outlets disposed transverse with respect to the sprayer and laterally spaced from each other. The method also includes selectively flowing water from the inlet to a first chamber in the sprayer and hence to the first outlet, the water flow drawing concentrated product from a first container to the first chamber and mixing with the flowing water, the water and product mixture then being sprayed from the first outlet. The method further includes selectively flowing water from the inlet to a second chamber in the sprayer and hence to the second outlet, the flowing water drawing concentrated product from a second container to the second chamber and mixing with the flowing water, the water and product mixture then being sprayed from the second outlet.

In another embodiment of the present invention, there is disclosed a method of spraying multi-component products comprising drawing a first component from a container into a chamber defined by a sprayer housing, the first component being drawn into the chamber by the reduced pressure produced by a flowing diluting fluid. The method also comprises drawing a second component from a container into the chamber, the second component being drawn into the chamber by the reduced pressure produced by the flowing diluting fluid. The method further comprises mixing the first and second component in the chamber before said mixture is diluted with the diluting fluid.

In another embodiment of the present invention, there is disclosed a seal for use between a fluid sprayer and a fluid container comprising a substantially disk-shaped body having peripheral portions adapted for sealing engagement between a container opening and a fluid sprayer. The body defines at least one passage from a side of the body adjacent the sprayer to a side adjacent the container. The body is adapted to mate with a tube extending into the container such that fluid in the container can flow through the passage. The body is further adapted to mate with a tube extending from the sprayer such that fluid in the passage can be delivered to the tube of said sprayer.

In another embodiment of the present invention, there is disclosed a product comprising two flowable concentrated liquid components that are to be applied in a dilute liquid form, one of the components being contained in a first container and the other of the components being contained in a second container. The first and second container are adapted to connect simultaneously to a liquid sprayer. The first and second containers are sized and shaped so that the relative volume capacities of the containers is such that the amount of the component contained in the first container when diluted with a diluting fluid in the sprayer treats the same amount of an item as the amount of the component contained in the second container when diluted with a diluting fluid in the sprayer.

In another embodiment of the present invention, there is disclosed a method comprising causing a first fluid to flow through a first passage, the first fluid drawing a second fluid into the first passage through a second passage that intersects the first passage. The first and second passages are sized and shaped such that the first and second fluids produce a consistent waveform in a portion of the first passage downstream of the intersection with the second passage.

Accordingly, it is an object of the present invention to provide an improved method and apparatus for spraying flowable substances.

Another object of the present invention is to provide an apparatus and method for mixing and spraying a multiple-component product.

A further object of the present invention is to provide a sprayer or dispenser that is relatively easy to assemble.

Still another object of the present invention is to provide a sprayer or dispenser that is efficient and effective in spraying flowable products.

Yet another object of the present invention is to provide a sprayer or dispenser that is relatively easy to use.

Another object of the present invention is to provide a sprayer or dispenser that is relatively easy to hold.

Still another object of the present invention is to provide a sprayer or dispenser that can spray or dispense multiple-component products sequentially without disassembly of the sprayer or dispenser.

A further object of the invention is to provide an apparatus for mixing a concentrated product with a diluent stream at precise dilution ratios independent of the pressure (within conventional ranges) of the diluent stream.

Another object of the present invention is to provide a sprayer or dispenser for spraying or dispensing two concentrated components at a precise dilution or dilutions.

A further object of the present invention is to provide a sprayer or dispenser that can spray or dispense a concentrated product diluted with a diluent at relatively low dilution ratios at relatively low diluent flow rates.

Yet another object of the present invention is to provide a sprayer that can spray a rich mixture of concentrated product and diluent on an object with a relatively low amount of splash back and without the surface being treated sustaining damaging force from a higher pressure impact.

Another object of the present invention is to provide a field portable apparatus for reestablishing the balance of ions, electrolytes or to introduce other essential bodily fluids in fluid blood products.

These and other objects, features and advantages of the present invention will become apparent after a review of the following detailed description of the disclosed embodiments and the appended drawing and claims.

DETAILED DESCRIPTION OF THE DISCLOSED EMBODIMENTS

Figure 1:
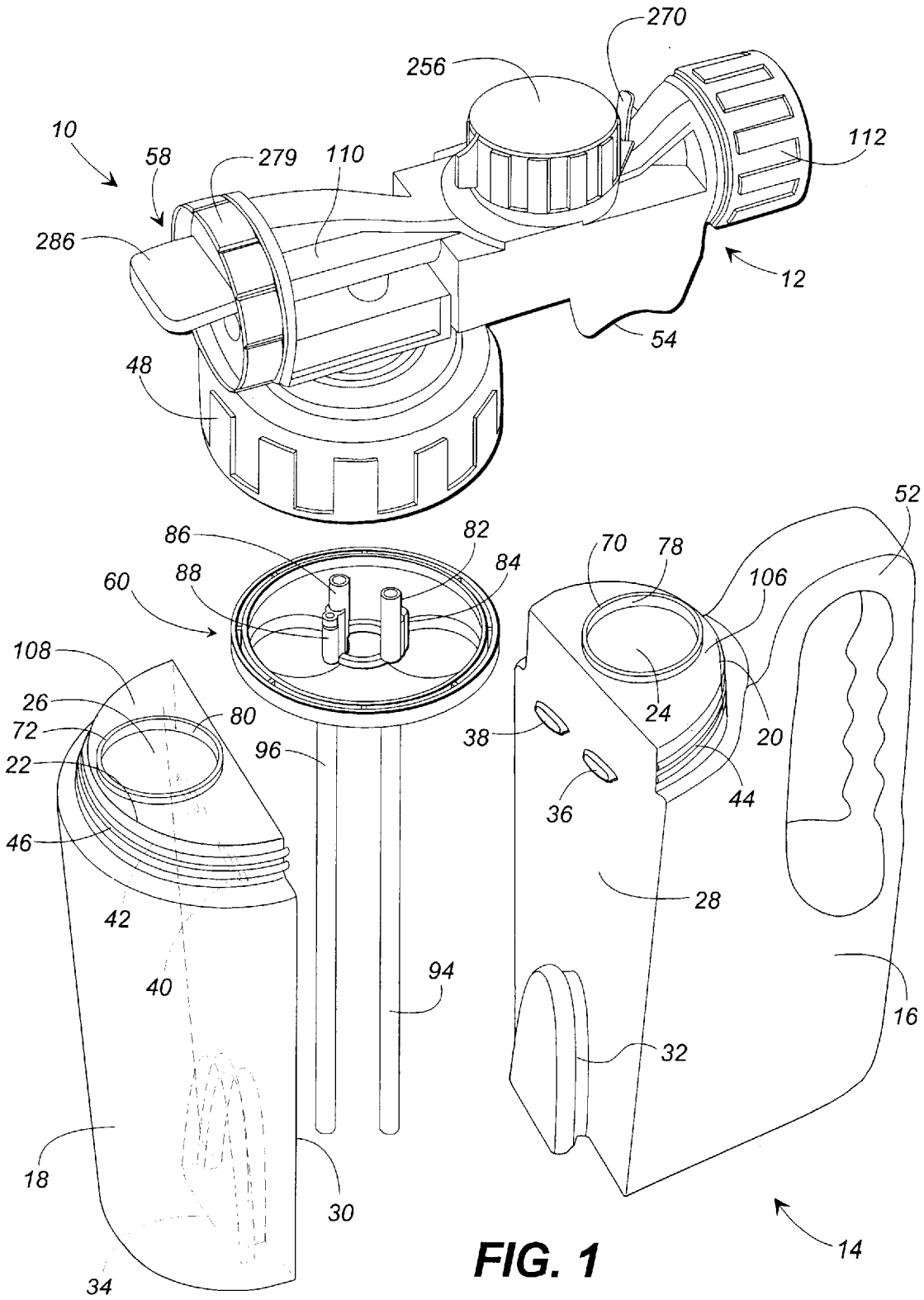
FIG. 1 is an exploded perspective view of a disclosed embodiment of the dispenser of the present invention.
Figure 2:
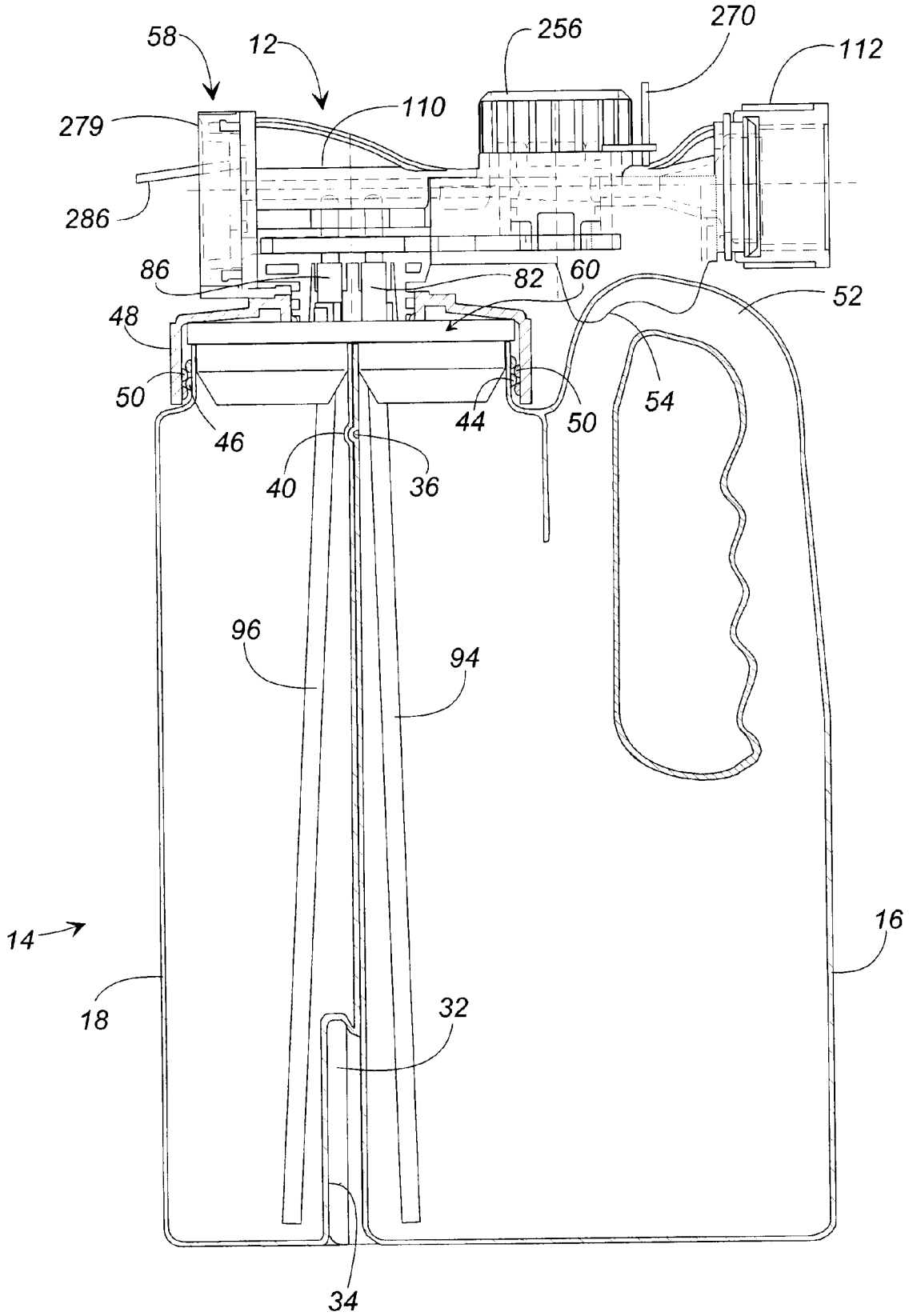
FIG. 2 is a partial cross-sectional side view of the sprayer shown in FIG. 1.
Figure 3:
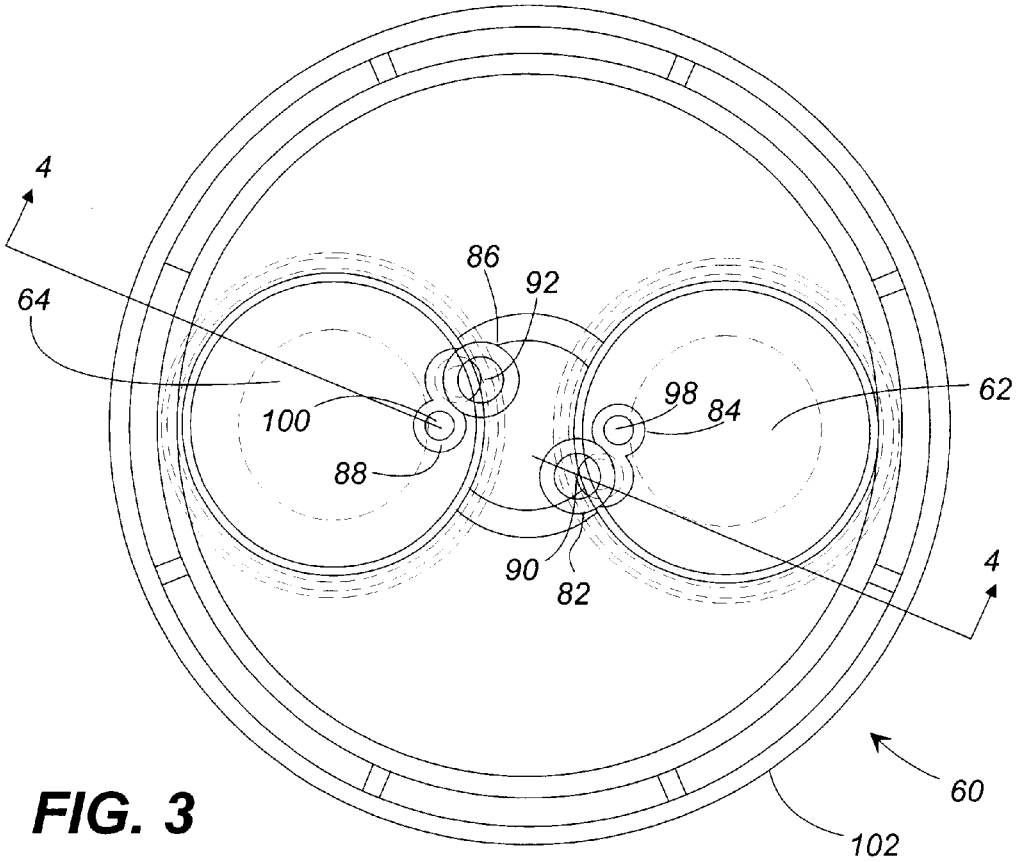
FIG. 3 is a top view of the bottle seal shown in FIG. 1.
Figure 4:
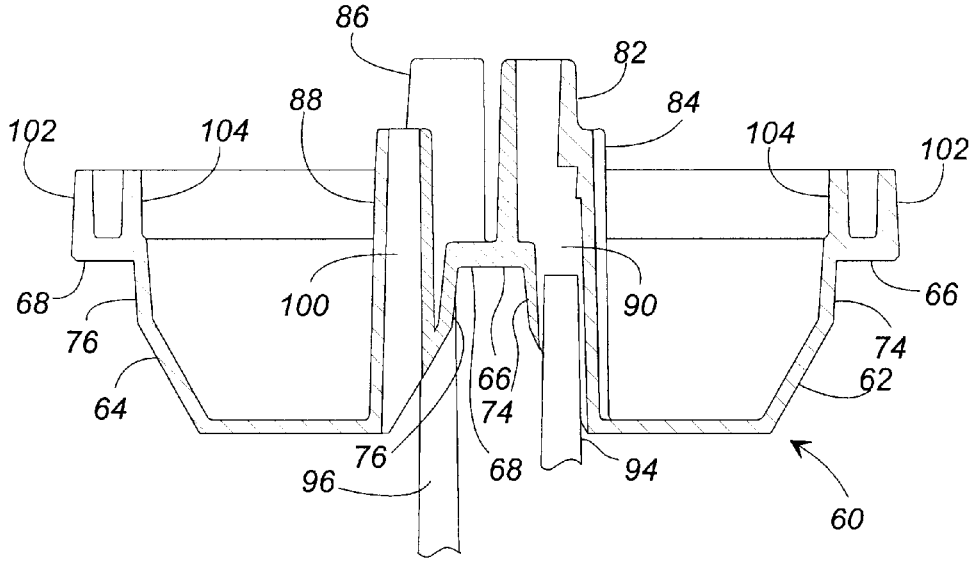
FIG. 4 is a cross-sectional view of the bottle seal shown in FIG. 3 taken along the line 4—4.

With reference to the drawing in which like numbers indicate like elements throughout the several views, it can be seen that there is a sprayer 10 comprising a sprayer housing 12 and an attachable base 14 (FIGS. 1–2). The base 14 comprises a first fluid container 16 and a second fluid container 18. Each fluid container 16, 18 includes an upstanding neck portion 20, 22. Each fluid container 16, 18 is sealed except for the openings 24, 26, respectively in the neck portions 20, 22. Prior to use, the openings 24, 26 can be sealed by adhesively attaching removable fluid-proof sealing members (not shown) over the openings. The fluid containers 16, 18 are designed to contain fluids. The particular nature of the fluids is not critical to the present invention, except for the fact that the fluids should be designed to be mixed with and diluted with another fluid, such as water, before use. It is specifically contemplated that the fluid container 16 should hold a different fluid from that contained in the fluid container 18. Each fluid component contained in the fluid containers 16, 18 may be designed to be mixed with another fluid independent of the other fluid component, or the two fluid components may be designed to be mixed together and diluted with an additional fluid. Examples of fluid components useful in the present invention include, but are not limited to, the following fluid products or fluid solutions, suspensions or emulsions of the following products: cleaners, such as detergents or surfactants, disinfectants, colorants, such as stains, multiple-part coatings, adhesives, such as multi-part epoxies (e.g.; epoxy resins and hardeners), drugs, such as heparin, waxes, sealers, such as film-forming compositions, sheen aids, pesticides, such as herbicides, for example selective herbicides, including turf-safe herbicide and broad-leaf-safe herbicide for shrubs, insecticides and fungicides, fertilizers, plant growth regulators, nutritive electrolytes, blood products, flavorants, such as beverage syrups, and the like. Furthermore, the present invention has been illustrated with the first fluid container 16 having a larger fluid-holding capacity than the second fluid container 18. However, it is specifically contemplated that the fluid-holding capacity of the first and second fluid containers 16, 18 can be the same. Furthermore, while the present invention has been illustrated as using two fluid containers for two fluid components, it is specifically contemplated that the present invention can be used with multiple fluid components and/or multiple fluid containers.

Each fluid container 16, 18 includes a substantially flat side portion 28, 30, respectively, such that the fluid containers can be arranged with their flat sides abutting each other, as shown in FIG. 2. Disposed on the flat side 28 of the first fluid container 16 adjacent the bottom thereof is a projection 32. Formed in the flat side 30 of the second fluid container 18 adjacent the bottom thereof is a mating recess 34. The projection 32 and the recess 34 are sized and shaped so that the first and second fluid containers 16, 18 may be joined together and retained together by interlocking the projection within the recess. The projection 32 can be interlocked with the recess 34 by placing the fluid containers 16, 18 in a position with their flat sides 28, 30 abutting and the bottom of the second container 18 positioned above the projection. The second fluid container 18 is then slid longitudinally with respect to the first fluid container 16 until the bottoms of the two fluid containers are co-planar. Since the projection 32 is wider at a point distal from the flat side 28 than it is adjacent the flat side, i.e., the projection flares out, and since the recess 34 is narrower adjacent the flat side 30 of the second fluid container 18 than it is at a point distal from the flat side, the projection cannot be removed from the recess by applying a lateral separation force to the two fluid containers, and, thus, resists transverse separation and twisting separation of the two fluid containers with respect to each other.

Formed on the flat side 28 of the first fluid container 16 adjacent the neck portion 20 thereof are two laterally spaced projections 36, 38. Formed on the flat side 30 of the second fluid container 18 adjacent the neck portion 22 thereof are two laterally spaced recesses 40, 42. The projections 36, 38 and the recesses 40, 42 are sized and shaped so that the projections are received within the recesses to thereby resist longitudinal separation of the two containers 16, 18 with respect to each other. The intermitting projections 36, 38 and recesses 40, 42, in combination with the interlocking projection 32 and recess 34, thus, resist separation forces applied to the two fluid containers 16, 18 in three directions.

Each neck portion 20, 22 is semi-circular in shape so that when the two flat side portions 28, 30 of the fluid containers 16, 18 are placed together, the two neck portions form a cylindrical neck that is designed to be attached to the sprayer housing 12. To facilitate the attachment of the cylindrical neck to the sprayer housing 12, each of the two neck portions 20, 22 are provided with threads 44, 46, respectively. A cap or collar 48 is rotatably mounted to the sprayer housing 12. The inside of the collar 48 is provided with threads 50 designed to mate with the threads 44, 46 on the neck portions 20, 22. Thus, when the two fluid containers 16, 18 are joined as described above, the sprayer housing 12 can be attached thereto by screwing the collar 48 onto the two neck portions 20, 22.

Figure 6:
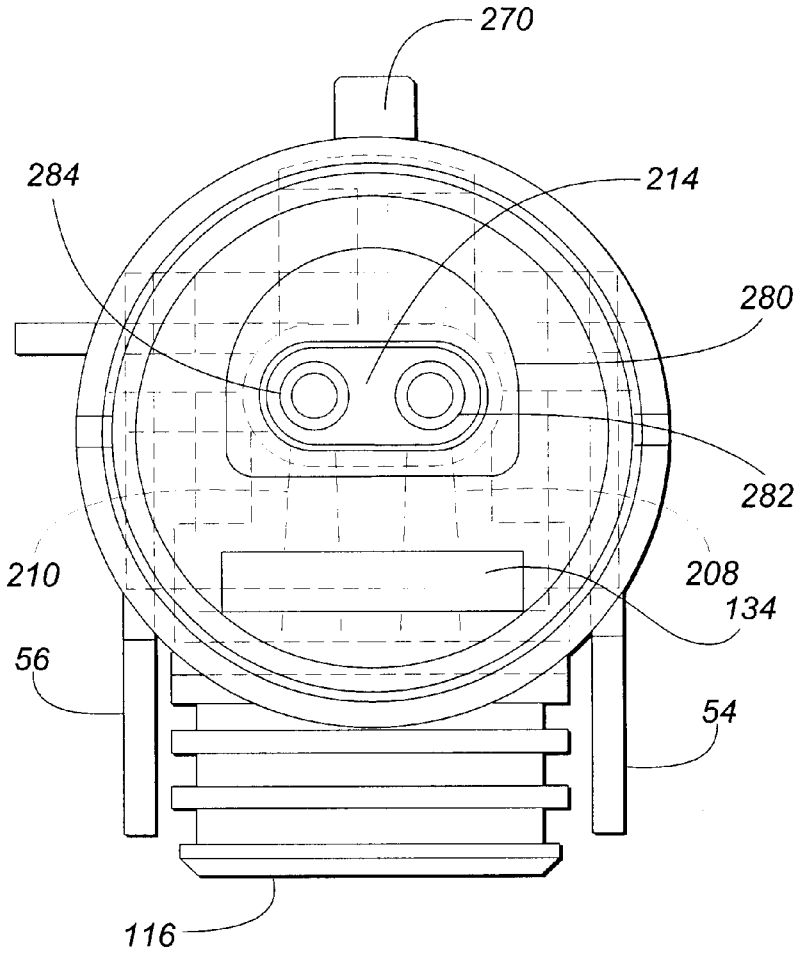
FIG. 6 is a partial front view of the sprayer housing shown in FIG. 1.
Figure 7:
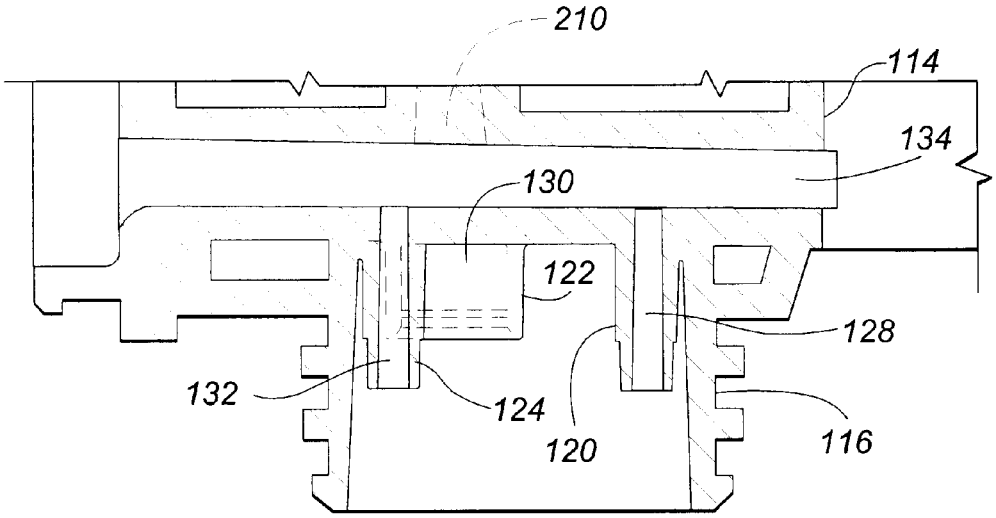
FIG. 7 is a partial cross-sectional side view of the sprayer housing shown in FIG. 1.
Figure 8:
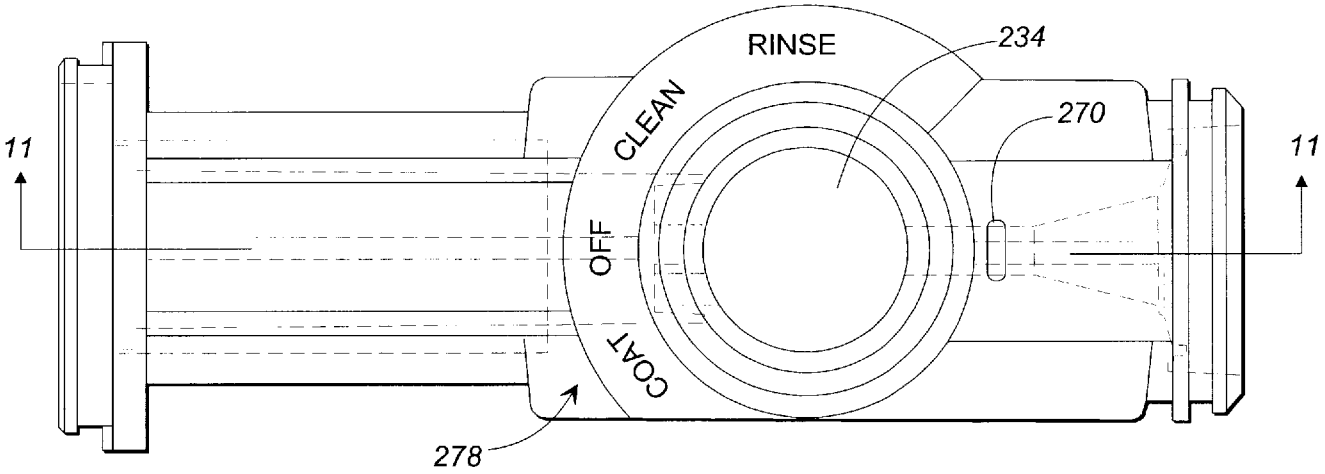
FIG. 8 is a partial top view of the sprayer housing shown in FIG. 1.
Figure 9:
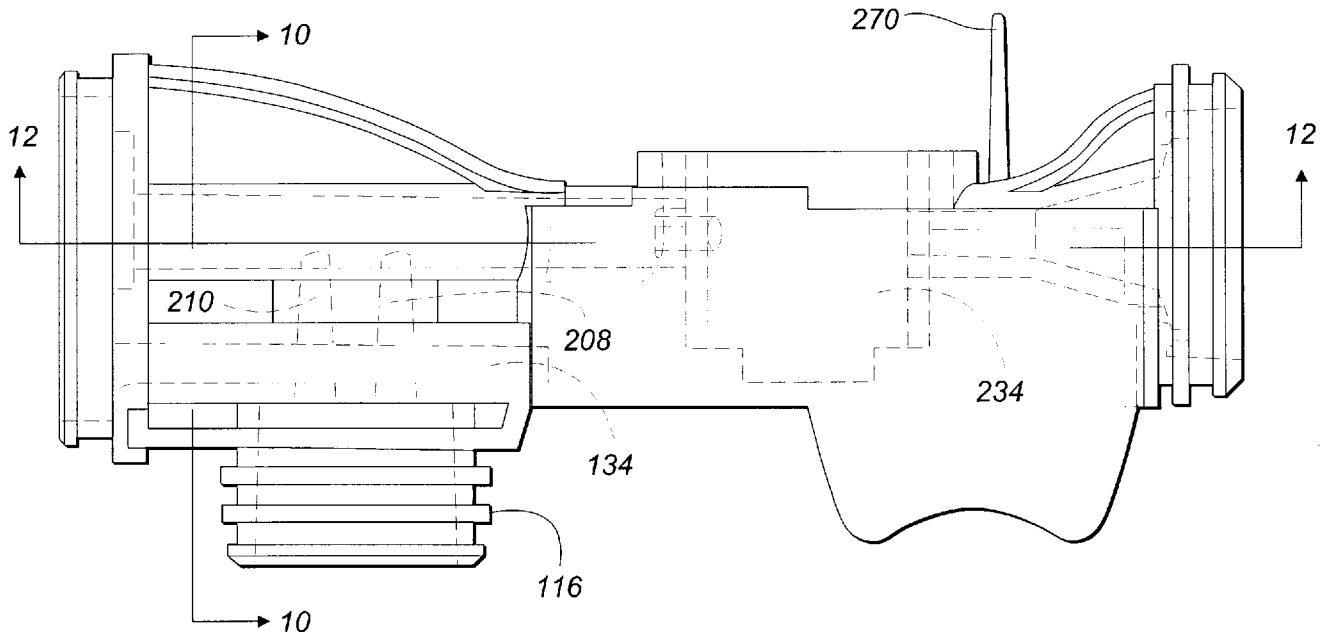
FIG. 9 is a partial side view of the sprayer housing shown in FIG. 1.
Figure 10:
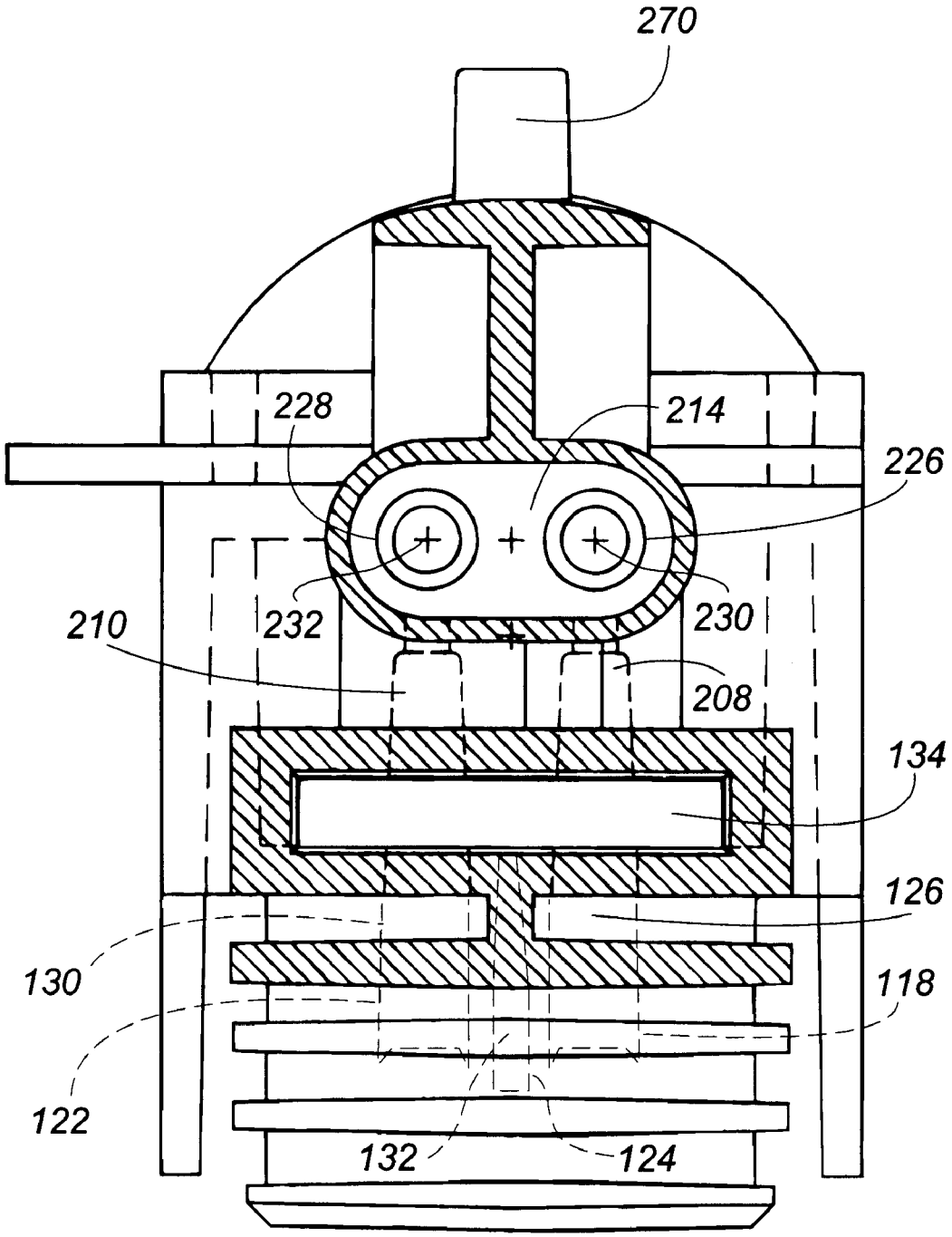
FIG. 10 is a front cross-sectional view of the sprayer housing shown in FIG. 9 taken along the line 10—10 shown with the sprayer insert in place.
Figure 11:
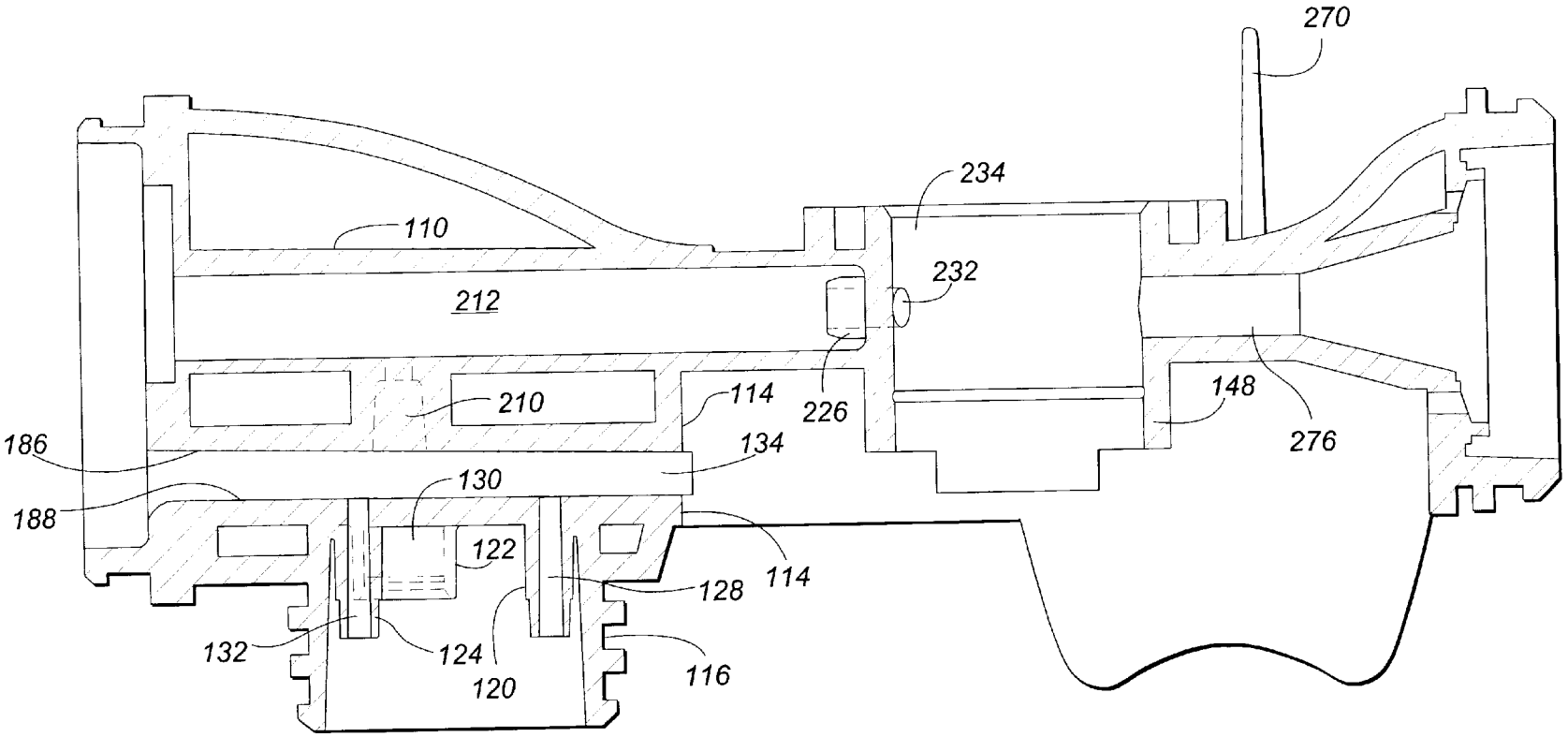
FIG. 11 is a side cross-sectional view of the sprayer housing shown in FIG. 8 taken along the line 11—11.
Figure 12:
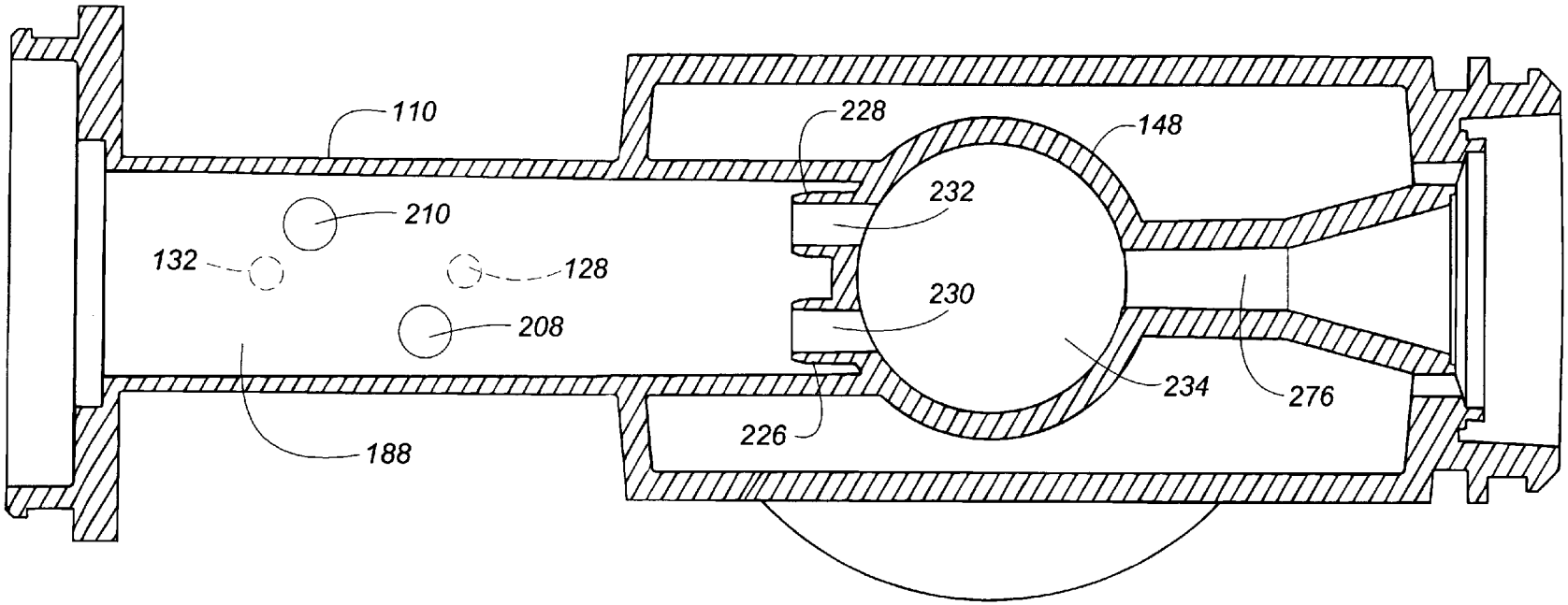
FIG. 12 is a top cross-sectional view of the sprayer housing shown in FIG. 9 taken along the line 12—12.

The first fluid container 16 includes an upstanding handle portion 52. The sprayer housing 12 includes at least one, and preferably two laterally spaced, downwardly extending flanges 54, 56 (FIG. 6). The handle portion 52 and the flanges 54, 56 are sized and shaped such that the handle fits between the two flanges when the collar 48 is attached to the neck portions 20, 22. Since the collar 48 is rotatable with respect to the housing 12, the housing can be positioned such that the flanges 54, 56 engage the handle 52 and then the collar 48 can be screwed onto the base 14. This feature achieves automatic alignment of the housing 12 and the base 14 such that the sprayer end 58 of the housing is distal from the handle 52.

Positioned between the collar 48 and the neck portions 20, 22 is a bottle seal 60 (FIGS. 1–4 and 7). The bottle seal 60 is made from an elastomeric material that is flexible and resilient, such as natural or synthetic rubber or polymeric materials, such as polyurethane, silicone rubber or thermoplastic elastomers. The bottle seal 60 is substantially disk-shaped and is sized and shaped to fit within the collar 48. The bottle seal 60 includes two downwardly extending wells 62, 64 that are sized and shaped to fit snugly within the openings 24, 26, respectively. The peripheral, horizontal under surfaces 66, 68 surrounding each well 62, 64, respectively, contact the inner diameter and the upper surface 70, 72 of the lip of each openings 24, 26, respectively, and seal against them. Similarly, the outer vertical side walls 74, 76 of each well 62, 64 contact the inner vertical side walls 78, 80, respectively, of the lip of each opening 24, 26, respectively, and seal against them.

Extending upwardly from the bottle seal 60 are a pair of nipples 82, 84 associated with the well 62 and a pair of nipples 86, 88 associated with the well 64. The nipples 82, 86 each define a passage 90, 92, respectively, that extend from the top side of the bottle seal 60 to the bottom side of the bottle seal. As can be seen most clearly in FIG. 4, the passages 90, 92 are not straight, but, rather, are offset at their approximate midpoint. This permits the upper portions of the nipples 82, 86 to be spaced laterally closer together than the lower portions of those nipples. As can also be seen from FIG. 4, the lower portions of the nipples 82, 86 are co-terminus with the slanted side walls of the wells 62, 64, respectively. The lower portion of each passage 90, 92 is sized and shaped to receive the end of a suction tube 94, 96, and to retain the suction tube therein by friction. Alternately, the suction tubes 94, 96 can be adhesively attached to the lower portion of each passage 90, 92. When the wells 62, 64 are positioned within the openings 24, 26, the suction tubes 94, 96 extend downwardly into the fluid containers 16, 18, respectively, so that liquid within the fluid containers can be drawn through the suction tubes and hence through their respective passages 90, 92.

The nipples 84, 88 each define a passage 98, 100, respectively, that extend from the top side of the bottle seal 60 to the bottom side of the bottle seal. As can be seen most clearly in FIG. 4, the passages 98, 100 are straight. As can also be seen from FIG. 4, the lower portions of the nipples 84, 88 are co-terminus with the slanted side walls of the wells 62, 64, respectively. When the wells 62, 64 are positioned within the openings 24, 26, the passages 98, 100 are in fluid communication with the air space above the fluids contained in the fluid containers 16, 18. Thus, air can flow through each passage 98, 100 into the upper portion of each fluid container 16, 18, respectively, as liquid is withdrawn from the containers through the suction tubes 94, 96.

The bottle seal 60 also includes upwardly extending peripheral flanges 102, 104. When the collar 48 is screwed down on to the neck portions 20, 22, the flanges 102, 104 contact the under surface of the collar and seal against it. When contacted as described, the flanges 102, 104 also provide a compressive force to the peripheral portion of the bottle seal 60 to urge it into intimate contact with the top surface 106, 108 of each neck portion 20, 22, respectively.

The sprayer housing 12 comprises an elongate sprayer barrel 110 (FIGS. 1, 2, 8, 9, 11, and 12) having a rotatably attached coupling 112 at the rear end of the sprayer barrel adapted to attach to a source of fluid, such as water, under pressure, such as a garden hose (not shown). The sprayer housing 12 also includes a slide valve housing 114 disposed below the barrel 110 and a hollow shaft 116 extending downwardly from the slide valve housing 114 upon which the collar 48 is rotatably mounted. Extending downwardly from the slide valve housing 114 and within the hollow shaft 116 are four nipples 118, 120, 122, 124. The nipples 118–124 define passages 126, 128, 130, 132 that extend from a slide valve chamber 134 defined by the slide valve housing 114 to the opposite end of the nipples. Thus, fluid can flow from the slide valve chamber 134 through the nipples and out the end of the nipples disposed within the hollow shaft 116.

The nipples 118–124 are arranged on the sprayer housing 12 so that they will align with the nipples 82–88 when the bottle seal 60 is positioned within the collar 48. The nipples 82, 118 are sized and shaped so that the end of the nipple 82 will fit into the nipple 118 in a fluid sealing relationship, the nipple 86 will fit into the nipple 122 in a fluid sealing relationship, the nipple 120 will fit into the nipple 84 in a fluid sealing relationship and the nipple 124 will fit into the nipple 88 in a fluid sealing relationship. When the nipples 118–124 are joined with the nipples 82–88 as previously described, fluid can flow from the fluid container 16 through the suction tube 94, through the passage 90, through the passage 126 to the slide valve chamber 134. Similarly, fluid can flow from the fluid container 18 through the suction tube 96, through the passage 92, through the passage 130 to the slide valve chamber 134. In addition, air can flow from the slide valve chamber 134 through the passage 128, through the passage 98 into the air space above fluid contained in the fluid container 16. Similarly, air can flow from the slide valve chamber 134 through the passage 132, through the passage 100 into the air space above fluid contained in the fluid container 18.

Figure 16:
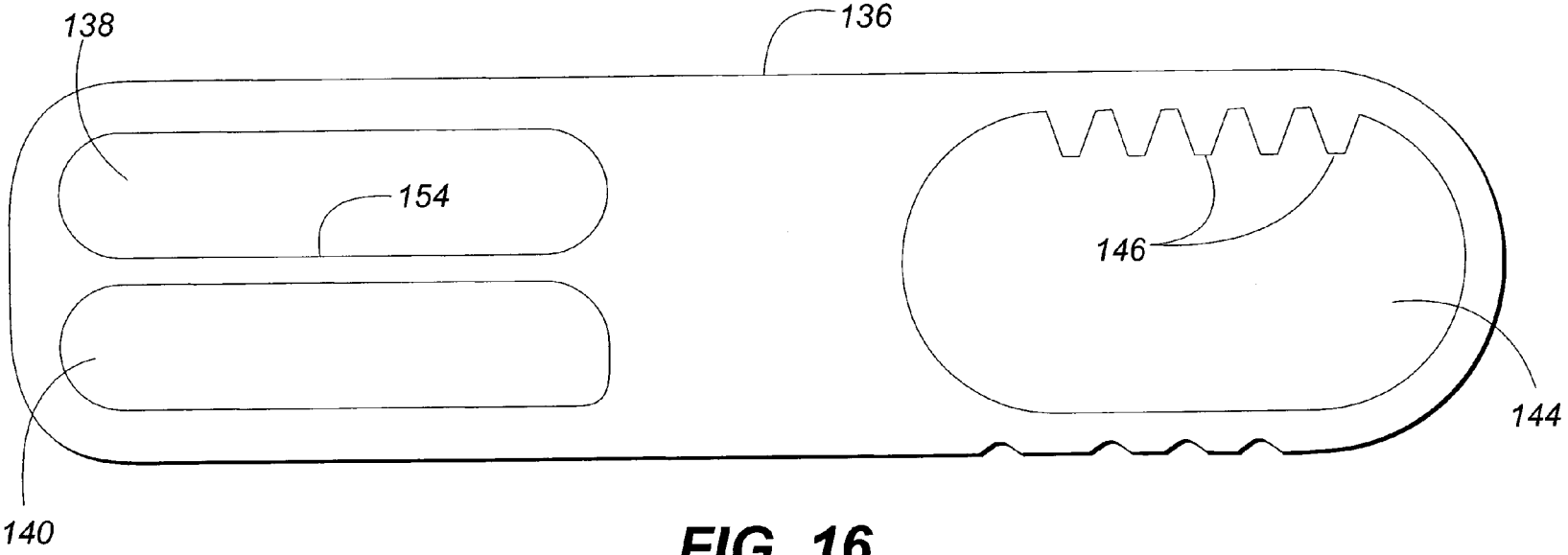
FIG. 16 is a top view of a slide used with the sprayer shown in FIG. 1.
Figure 18:
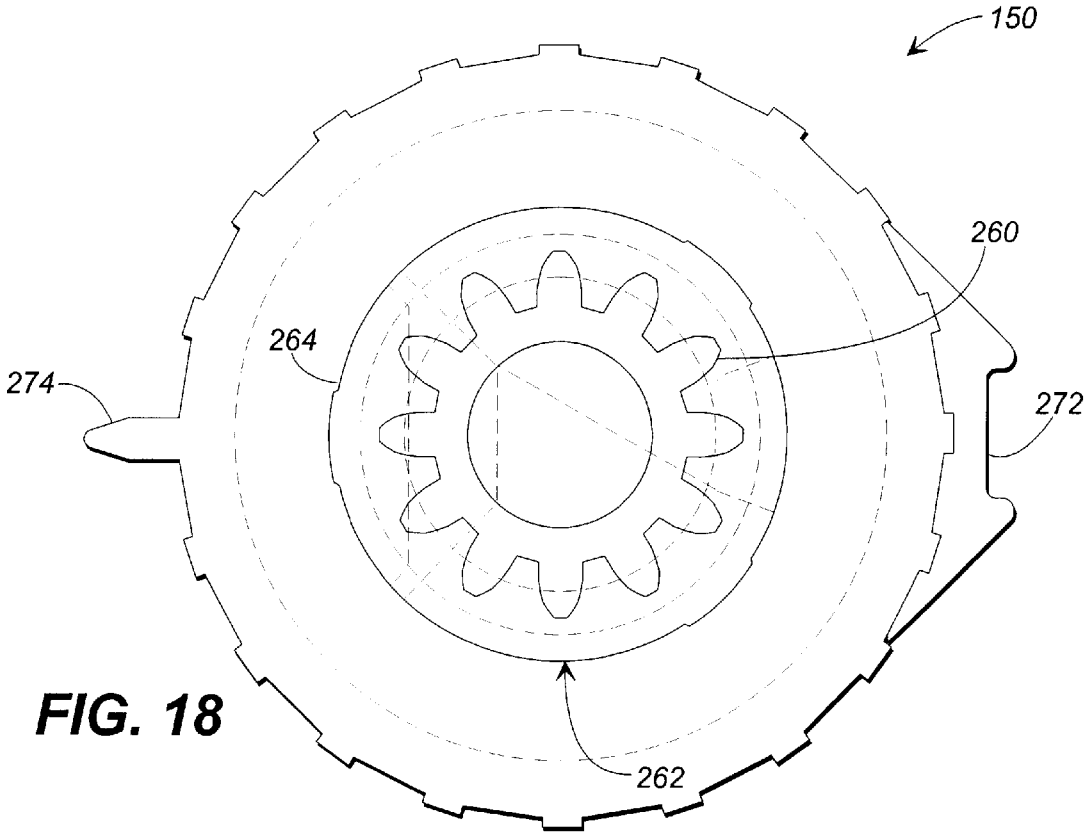
FIG. 18 is a top view of the rotary valve shown in FIG. 17.
Figure 17:
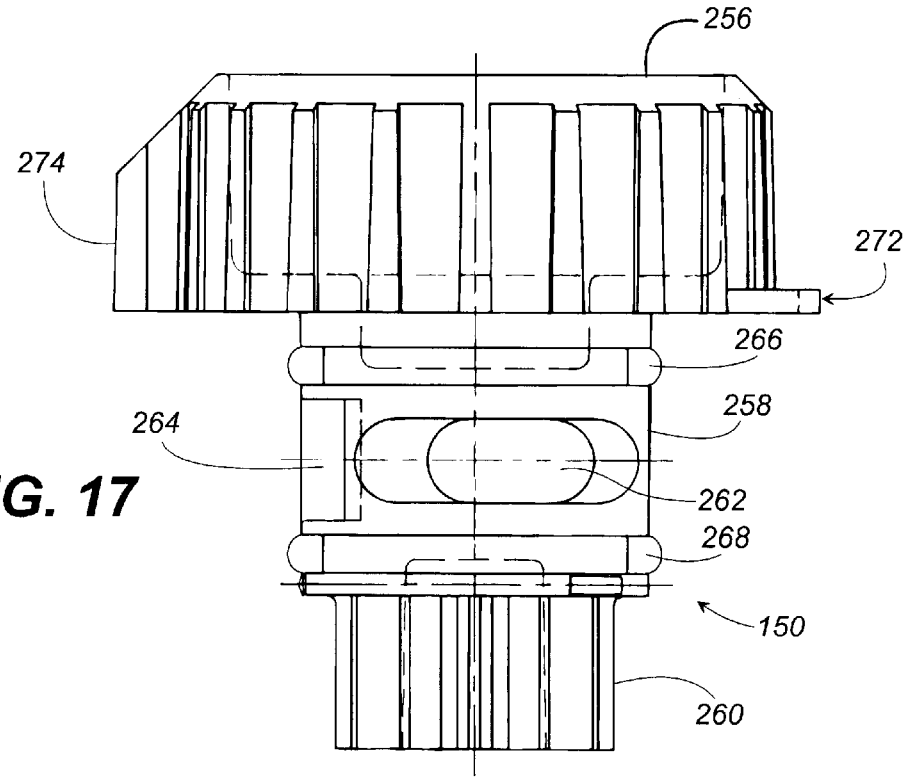
FIG. 17 is a side view of a rotary valve used with the sprayer shown in FIG. 1.
Figure 19:
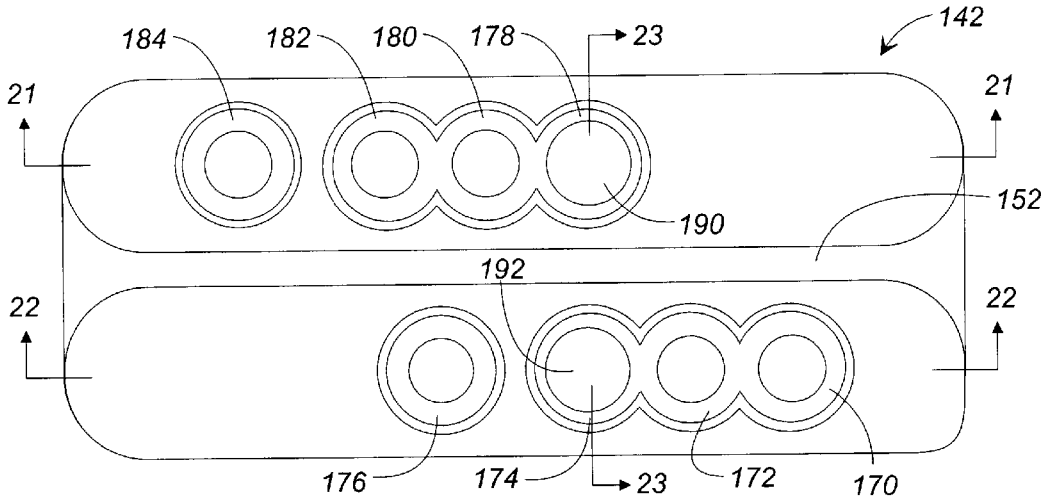
FIG. 19 is a top view of a slider seal used with the sprayer shown in FIG. 1.
Figure 21:
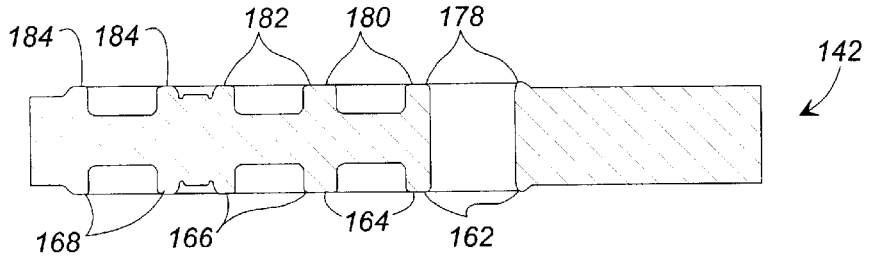
FIG. 21 is a side cross-sectional view of the slider seal shown in FIG. 19 taken along the line 21—21.
Figure 22:
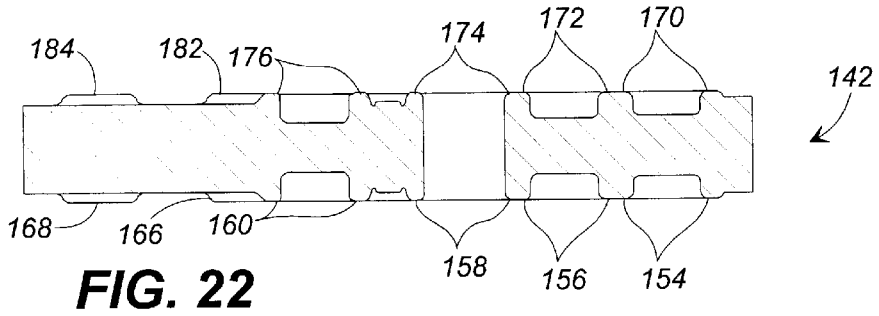
FIG. 22 is a side cross-sectional view of the slider seal shown in FIG. 19 taken along the line 22—22.
Figure 23:
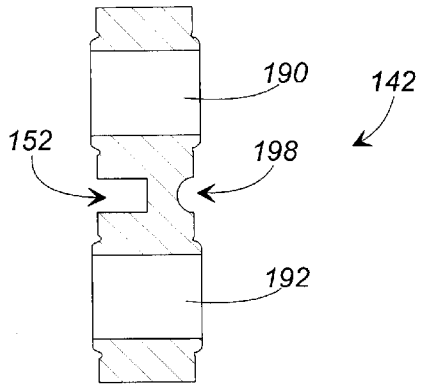
FIG. 23 is an end cross-sectional view of the slider seal shown in FIG. 19 taken along the line 23—23.
Figure 20:
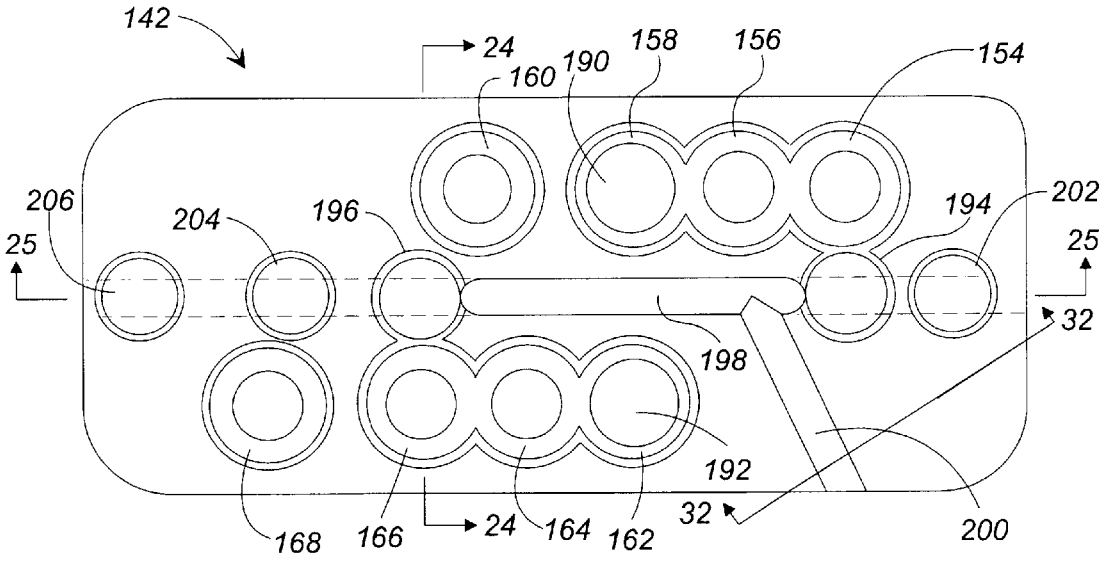
FIG. 20 is a bottom view of the slider seal shown in FIG. 19.
Figure 24:
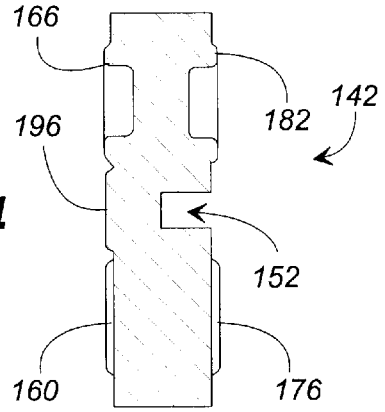
FIG. 24 is an end cross-sectional view of the slider seal shown in FIG. 20 taken along the line 24—24.

Slidably received in the slide valve chamber 134 is a slide 136 (FIG. 16). The slide 136 defines a pair of openings 138, 140 for mounting a slider seal 142 (FIGS. 19–25) and also defines an opening 144 having gear teeth 146 disposed therein. The slide 136 is disposed in the slide valve chamber 134 such that the openings 138, 140 are adjacent the passages 126–132 and the opening 144 is adjacent a rotary valve housing 148 for receiving a rotatable valve 150. The slider seal 142 is made from an elastomeric material that is flexible and resilient, such as natural or synthetic rubber or polymeric materials, such as polyurethane, silicone rubber or thermoplastic elastomers. The slider seal 142 includes a channel 152 for receiving a crossbar 154 that separates the opening 138 from the opening 140.

The slider seal 142 also includes a plurality of raised portions 154–168 on the top of the slider seal and a plurality of corresponding raised portions 170–184 on the bottom of the slider seal for sliding and sealing engagement with the top surface 186 and bottom surface 188 of the slide valve chamber 134. The slider seal 142 further defines a pair of openings 190, 192 that extend from one side of the slider seal 142 to the other so that fluid can pass therethrough. The slider seal 142 also includes a pair of raised portions 194, 196 that bound a longitudinal, centrally disposed channel 198. The channel 198 intersects an angled channel 200 that extends from the central channel 198 to the edge of the slider seal 142. The slider seal 142 also includes raised portions 202–206 longitudinally aligned with the raised portions 194, 196.

The slide valve housing 114 also defines a pair of passages 208, 210 that extend from the slide valve chamber 134 to an insert chamber 212 so that fluid can flow from the slide valve chamber 134 to the insert chamber 212. The passage 208 is axially aligned with the passage 126; the passage 210 is axially aligned with the passage 130.

Figure 13:
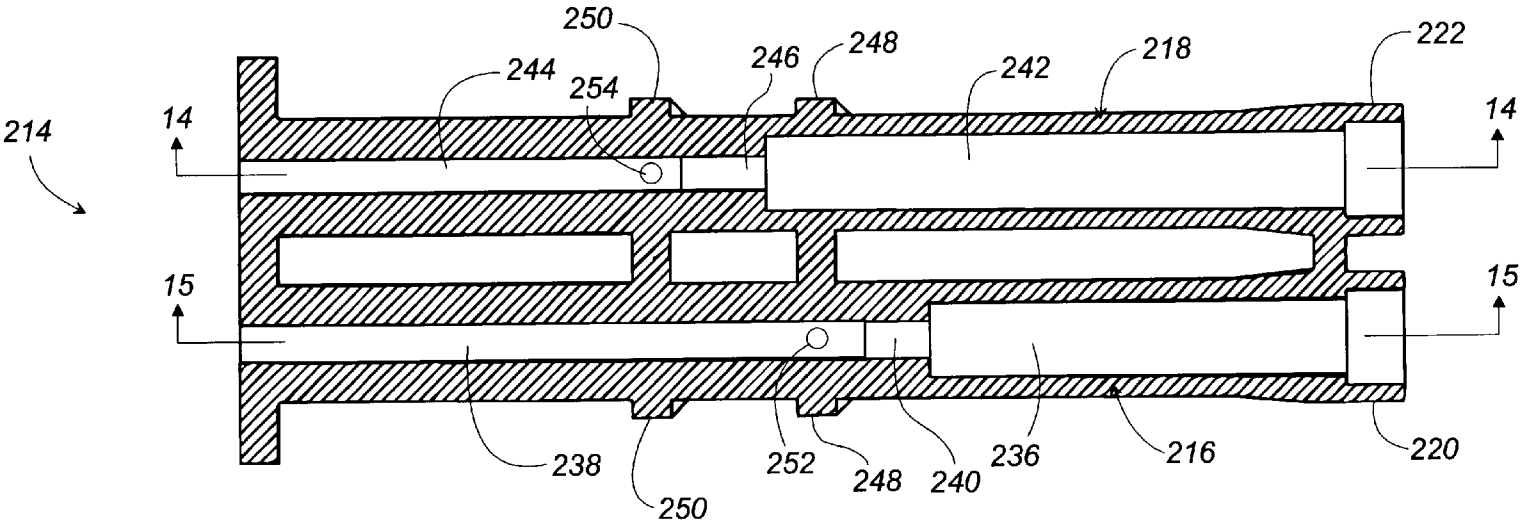
FIG. 13 is a top cross-sectional view of the sprayer insert shown in FIG. 1.
Figure 14:
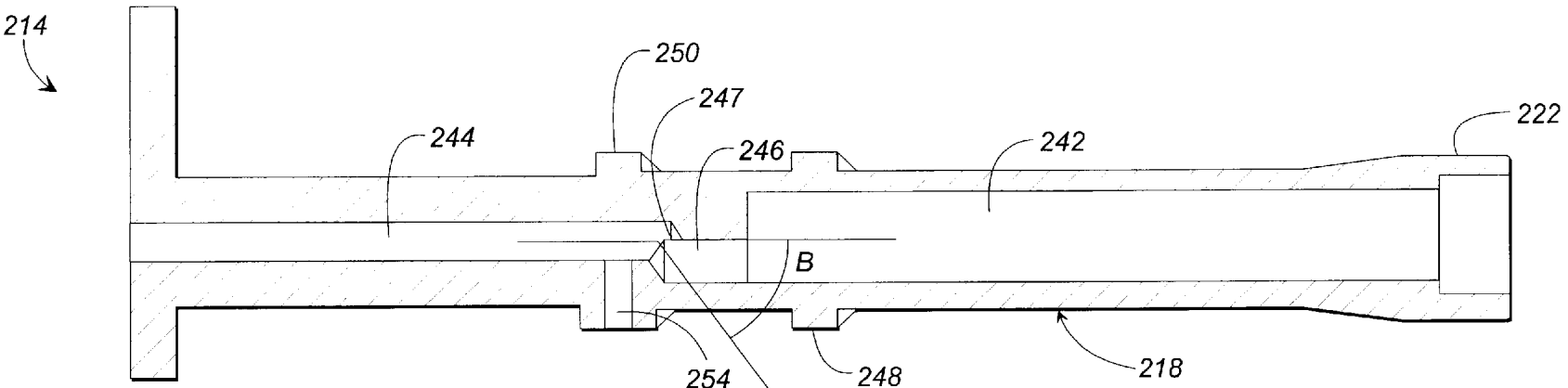
FIG. 14 is a side cross-sectional view of the sprayer insert shown in FIG. 13 taken along the line 14—14.
Figure 15:
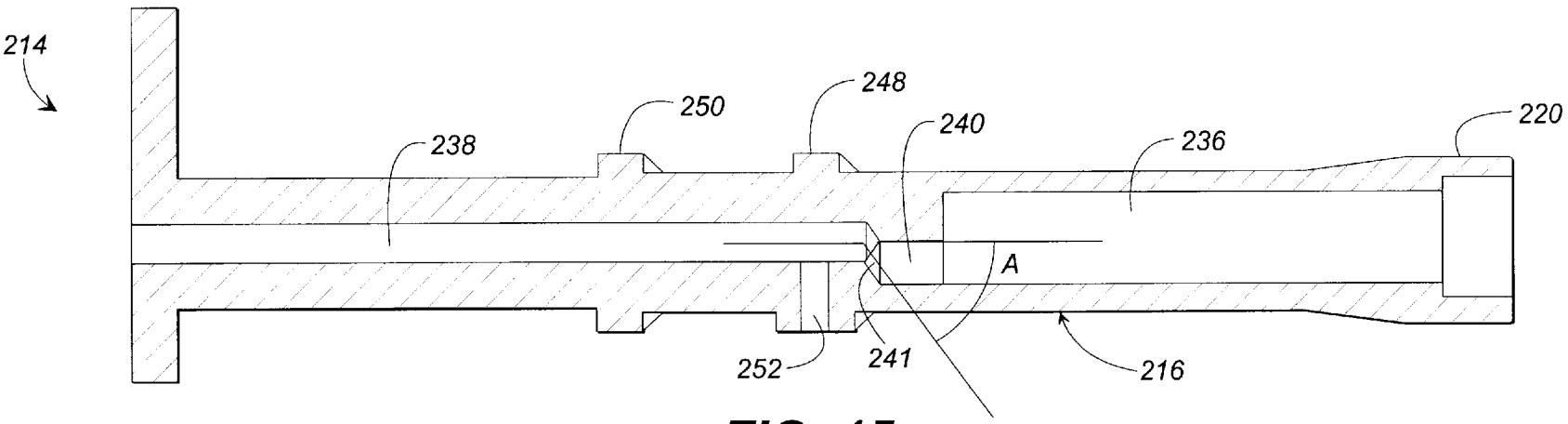
FIG. 15 is a side cross-sectional view of the sprayer insert shown in FIG. 13 taken along the line 15—15.

Receivable within the insert chamber 212 is a sprayer insert 214 (FIGS. 13–15). The sprayer insert 214 defines two side-by-side spray paths 216, 218. The sprayer insert 214 includes a coupling 220, 222 associated with each spray path 216, 218, respectively. The couplings 220, 222 are sized and shaped to receive and mate in a fluidtight relationship with a pair of nipples 226, 228 that extend outwardly from the rotary valve housing 148 into the insert chamber 212. The nipples 226, 228 each define a passage 230, 232 that extends from the chamber 234 defined by the rotary valve housing 148 to the insert chamber 212 so that fluid can flow therethrough. The left fluid path 216 comprises an upstream portion or first portion or passage 236 and a downstream portion or second portion or passage 238 that are coaxially aligned, but the upstream or first portion or passage is of a larger lateral cross-sectional area than the downstream or second portion or passage. The first passage 236 is connected to the second passage 238 by a third passage 240 that is of the same lateral cross-sectional area as the second passage, but is eccentrically aligned with respect to both the first and second passages. The eccentricity of the passage 240 with respect to the passage 238 creates an inclined ramp portion 241 connecting the passages 238, 240. The longitudinal axis of the second passage 238 forms an acute angle with respect to the longitudinal axis of the ramp portion 241 of the third passage 240, such as at A (FIG. 15). The third passage 240 and the ramp portion 241 formed thereby is an extension of and therefore forms a portion of the upstream or first portion or passage 236 thereby forming an interconnection between the upstream or first portion or passage and the downstream or second portion or passage. The right fluid path 218 comprises a first passage 242 and a second passage 244 that are coaxially aligned, but the first passage is of a larger lateral cross-sectional area than the second passage. The first passage 242 is connected to the second passage 244 by a third passage 246 that is of the same lateral cross-sectional area as the second passage, but is eccentrically aligned with respect to both the first and second passages. The eccentricity of the passage 246 with respect to the passage 244 creates an inclined ramp portion 247 connecting the passages 244, 246. The longitudinal axis of the second passage 244 forms an acute angle with respect to the longitudinal axis of the ramp portion 247 of the third passage 246, such as at B (FIG. 14).

The sprayer insert 214 includes a pair of collars 248, 250 that surround the barrel of the insert. The collars 248, 250 are sized and shaped so that they fit tightly within the insert chamber 212. The collar 248 defines a passage 252 that extends downwardly from the second passage 238 of the left spray path 216. The collar 248 is disposed on the barrel of the spray insert 214 so that when the nipples 226, 228 are received in the couplings 220, 222, the collar fits over the passage 208 so that the passage 252 is axially aligned with the passage 208 and fluid can flow therethrough. Similarly, the collar 250 defines a passage 254 that extends downwardly from the second passage 244 of the right spray path 218. The collar 250 is disposed on the barrel of the sprayer insert 214 so that when the nipples 226, 228 are received in the couplings 220, 222, the collar fits over the passage 210 so that the passage 254 is axially aligned with the passage 210 and fluid can flow therethrough.

Disposed in the chamber 234 is a rotary valve 150 comprising selector knob 256, a shaft portion 258 and a gear having gear teeth 260. Formed in the shaft portion 258 of the rotary valve 150 is a passage 262 that extends from one side of the shaft portion to the other. A gasket 264 is disposed in a notch formed in the shaft portion 258 and O-rings 266, 268 provide a fluidtight seal against the walls of the rotary valve housing 148. When the rotary valve 150 is disposed in the rotary valve housing 148 and the slide 136 is disposed in the slide valve housing 114, the gear teeth 260 of the rotary valve mesh with the gear teeth 146 of the slide such that rotary motion of the rotary valve, such as by turning the knob 256, moves the slide forward and backward within the slide valve chamber 134. Also, when the rotary valve 150 is disposed in the rotary valve housing 148, the shaft portion 258 is aligned with the passages 230, 232 and rotation of the knob selectively seals those passages with the gasket 264 or aligns those passages with the passage 262 through the shaft portion to permit fluid flow therethrough.

Thus, the rotation of the knob 256 can selectively direct fluid flow through either the left fluid path 216 or the right fluid path 218, both fluid paths or neither fluid path. Simultaneously, rotation of the knob 256 moves the slide 136 to selectively permit fluid flow through the passages 126, 208 or passages 130, 210 or neither of those passages. The openings 190, 192 in the slider seal 142 can therefore be selectively aligned with the passages 126, 130, respectively, and 208, 210, respectively, by moving the slide 136 forward or backward. Similarly, the channel 198 can be selectively aligned with the passages 128, 132 by moving the slide 136 forward or backward.

An upwardly extending finger 270 disposed behind the knob 256 of the rotary valve 150 is designed to engage a notch 272 formed in the knob opposite a pointer 274 so as to temporarily lock the knob in a desired location. The finger 270 is made of a material that is slightly flexible, such as plastic, and is sized and shaped so that the finger can be pulled backward to disengage the notch 272 and permit the knob 256 to be rotated in a desired direction.

The rear of the sprayer housing 12 defines a passage 276 that extends from the chamber 234 to the rotatable coupling 112 so that fluid from a source of fluid under pressure (not shown) attached to the coupling, such as a garden hose, can flow through the passage to the rotary valve 150 in the chamber 234.

Figure 5:
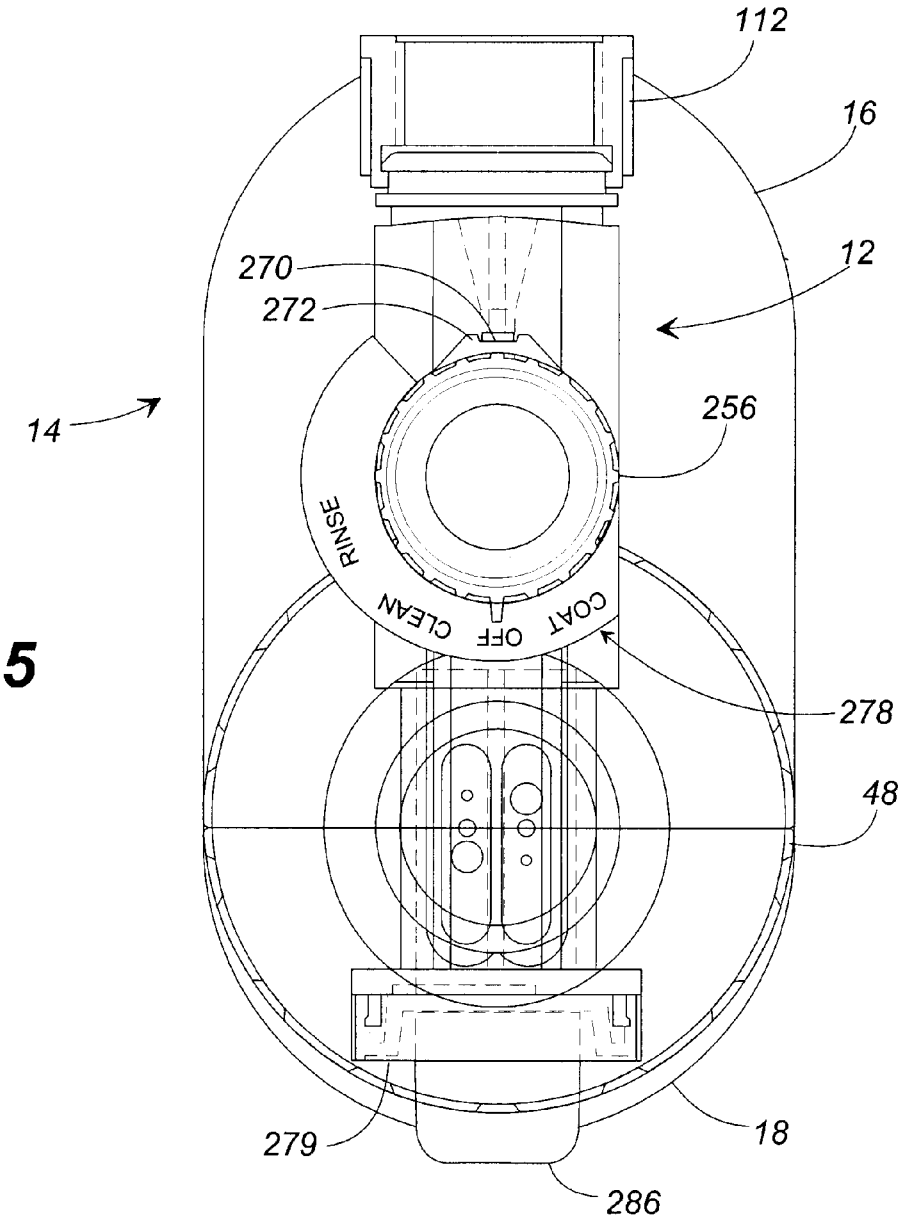
FIG. 5 is a top view of the sprayer housing shown in FIG. 1.

In the "OFF" position (FIG. 5); i.e.; when the pointer 274 on the knob 256 points to the indicia of the four indicia 278 indicating the "OFF" position, the raised portions 194, 196 are aligned with the passages 128, 132 so that the passages are sealed, the raised portions 156, 164 are aligned with the passages 126, 130, respectively, so that those passages are sealed and the gasket 264 covers both passages 230, 232 so that they are sealed and no fluid can flow therethrough. By rotating the knob 256 counterclockwise from the "OFF" position to the "COAT" position, the gear teeth 260 mesh with the teeth 146 and move the slide 136 forward in the chamber 134 so that the raised portions 162, 178 and the passage 190 are aligned with the passages 130, 210 so that fluid can flow therethrough, the passage 132 is aligned with the channel 198 so that air can flow therethrough, the raised portions 154, 170 are aligned with the passages 126, 208 so that they are sealed and the raised portion 202 is aligned with passage 128 so that it is sealed. By rotating the knob 256 clockwise from the "OFF" position to the "CLEAN" position, the gear teeth 260 mesh with the teeth 146 and move the slide 136 backward in the chamber 134 so that the raised portions 158, 174 and the passage 192 are aligned with the passages 126, 208 so that fluid can flow therethrough, the passage 128 is aligned with the channel 198 so that air can flow therethrough, the raised portions 166, 182 are aligned with the passages 130, 210 so that they are sealed and the raised portion 204 is aligned with passage 132 so that it is sealed. By further rotating the knob 256 clockwise from the "CLEAN" position to the "RINSE" position, the gear teeth 260 mesh with the teeth 146 and move the slide 136 further backward in the chamber 134 so that the raised portions 160, 176 and 168, 184 are aligned with the passages 126, 208 and 130, 210 respectively so that they are sealed and the passage 132 is aligned with the raised portion 206 so that it is sealed. The gasket 264 no longer covers either of the passages 230, 232 so that fluid flows from the passage 262 through both passages 230, 232 simultaneously.

Rotatably mounted on the spray end 58 of the sprayer housing 12 is a collar 279 that defines an opening 280 (FIG. 6) through which fluid can be sprayed from the nozzles 282, 284. The collar 279 is removable from the sprayer housing 12 so that the sprayer insert 214 can be inserted into the insert chamber 212. The collar 279 can then be re-attached to the sprayer housing 12 for normal operation. The collar 279 also includes a deflector 286 that extends outwardly from the collar and at an angle thereto. The deflector 286 is sized and shaped so that the fluid being sprayed from either of the nozzles 282, 284 will impinge the deflector when the deflector is in its upper horizontal position, as shown in FIG. 1. Although the collar 279 is rotatable, it is specifically contemplated that for most spraying situations when fluid is being sprayed from either or both nozzles 282, 284 that the deflector will be positioned horizontally so that fluid sprayed from either nozzles will impinge upon the deflector the same amount. However, when the collar 279 is rotated 180° from the position shown in FIG. 1, the deflector 286 will not intersect the fluid being sprayed from the nozzles. That position is desirable when the maximum spray pressure and/or fluid velocity is needed; for example, to clean a surface with only rinse water or to maximize the cleaning or stream distance.

Operation of the present invention will now be considered. It is contemplated that the present invention will be used to spray multiple-component systems, such as two-component systems, where the two components are incompatible under stored conditions, should be sprayed separately, should be sprayed sequentially, should have different dilution ratios, or the like. The present invention is therefore useful for spraying numerous components. However, in order to illustrate the present invention, a system for cleaning a wooden surface, such as a deck or a fence, and re-staining that surface will be described. Therefore, in the container 16 is placed a mixture of bleach (sodium hypochlorite) and detergent. This is a typical solution well known to those skilled in the art for cleaning mold and mildew from surfaces, such as wood. In the container 18 is placed a concentrated water repellent and film forming component. The relative sizes of the containers 16, 18 are such that the amount of cleaning solution in the container 16 will clean the same amount of wood as can be treated with the amount of stain in the container 18. Depending on the particular application, the relative volume capacities of the containers 16, 18 can be adjusted so that only enough of each component is provided to treat the same amount of an item with the two components after dilution or to treat an item to the same degree with the two components after dilution. It is contemplated that the containers 16, 18 will be sold commercially in pairs with the respective relative amounts of the components in the two containers at the appropriate respective concentrations to make ready-to-use dilutions. When packaged as described, the openings 24, 26 would be sealed by an adhesively attached sealing member, such as a plastic film (not shown), that can be removed from the openings by pealing the sealing members away from the openings or sealing plugs that fit into the openings, but can be manually removed therefrom.

In order to use the containers 16, 18 with the sprayer housing 12 the containers must be attached to each other by placing the top of the projection 32 into the bottom of the recess 34 and longitudinally sliding the containers relative to each other until the projections 36, 38 are received in the recesses 40, 42. When the containers 16, 18 are attached to each other as described above, the threads 44, 46 on the neck portions 20, 22 align so that the collar 48 can be screwed onto the threads in a conventional fashion.

In order to assemble the sprayer 10 of the present invention, the bottle seal 60 must be positioned so that the wells 62, 64 are within the openings 24, 26 so that the suction tubes 94, 96 extend downwardly into the containers 16, 18, respectively, and the nipples 82–88 of the bottle seal are mated with the nipples 118–124 of the sprayer housing 12. When screwing the sprayer housing 12 onto the containers 16, 18, the housing is positioned so that the flanges 54, 56 engage and capture the handle 52 therebetween. This properly positions the sprayer housing 12 with respect to the containers 16, 18 so that the sprayer end 58 is opposite the handle 52. The sprayer can then be attached to a garden hose (not shown) by screwing the coupling 112 onto the end of the hose. Water to the hose should then be turned on so that water in the hose is under pressure.

With the knob 256 in the "OFF" position, water from the garden hose (not shown) flows into the passage 276 but is stopped by the rotary valve 150. When it is desired to clean a wooden surface (not shown), such as a fence, the knob 256 is turned to the "CLEAN" position. In this position, water from the passage 276 flows through the passage 262 in the rotary valve 150 and through the passage 230, but not through passage 232 because the gasket 264 on the rotary valve covers and seals that passage 232. Water then flows from the passage 230 through the passages 236, 240

(including ramp portion 241) and 238 and exits the sprayer insert 214 at the spray end 58. As the flowing water in the passage 238 flows over the passage 252, it creates a relatively low-pressure area. This reduced pressure causes fluid in the container 16 to be pushed by atmospheric pressure up the suction tube 94, through the passage 90 in the bottle seal 60, through the passage 126 to the slide 136. Rotation of the rotary valve 150 from the "OFF" position to the "CLEAN" position moves the slide 136 so that the passage 192 in the slider seal 142 is aligned with the passage 126. This permits the fluid being pushed up through the passage 126 to flow through the passage 192 and hence through the passages 208, 252 and into the passage 238 where it joins the fluid flowing through the passage 238 and mixes therewith. The diluted mixture of water and bleach-based solution is then sprayed out the nozzle at the end 58 of the sprayer 10 where it impinges on the deflector 286; thus, producing a relatively flat, fan-shaped spray pattern. As fluid is drawn out of the container 16, air is drawn through the channels 200, 198, through the passages 128, 98 into the air space above the fluid in the container 16.

In this case the bleach-based concentrated cleaning solution mixes with the water flowing through the passage 238 and is diluted thereby to a desired concentration. By controlling the size of the passage 252 and of the passages 236, 240 (including the ramp portion 241) and 238, the ratio for the dilution of the concentrated fluid from the container 16 with water from the garden hose (not shown) can be controlled. Furthermore, with the present invention the dilution ratio is independent of bulk fluid flow through the passage 236 and independent of the water pressure (within conventional ranges) in the passage 236. Conventional pressures for garden hose-end applications range in pressures between approximately 20 and 70 psi. In the case of the bleach-based fluid in container 16, a low dilution ratio of between approximately 3 and 10 is useful. Since the dilution ratio is fixed by the dimensions of the passages 252, 236, 240 (including the ramp portion 241) and 238, it cannot be incorrectly set by the operator. The sprayer 10 can be moved back and forth so as to spray the diluted bleach-based solution onto the wooden surface to be treated. Furthermore, the design of the present invention permits relatively low dilution ratios (i.e., rich mixtures) at relatively low fluid flow rates.

After all of the bleach-based or detergent fluid in the container 16 has been sprayed from the sprayer 10, the knob 256 is turned to the "RINSE" position. In the "RINSE" position, water from the passage 276 flows through the passage 262 in the rotary valve 150 and through both passages 230, 232 because the gasket 264 on the rotary valve does not block either passage, but, rather, the passage 262 is aligned with both passages 230, 232. In the "RINSE" position, it may be desirable to rotate the collar 279 so that the deflector 286 does not intersect the stream of fluid spraying from the nozzles at the ends of the chambers 238, 244. It is sometimes desirable not to use the deflector 286 in the "RINSE" position so that the fluid being sprayed has its maximum velocity and pressure so that it can rinse or clean the surface being cleaned more effectively.

From the passages 230, 232 the water flows through the passages 236, 240 (including the ramp portion 241), 238 and 242, 246 (including the ramp portion 247), 244, respectively. As the water in the passages 238, 244 flows over the passages 208, 210 it creates a low-pressure area, but fluid is not drawn through the passages 208, 210 because the passages 208, 210 are sealed by the raised portions 160, 168, respectively. With fluid being sprayed from both passages 238, 244, the rinsing operation can be effected relatively quickly.

After the wooden surface (not shown) is sufficiently rinsed, the knob 256 is turned to the "COAT" position. In the "COAT" position, water from the passage 276 flows through the passage 262 in the rotary valve 150 and through the passage 232, but not through the passage 130 because the gasket 264 on the rotary valve covers and seals the passage 130. Water then flows from the passage 232 through the passages 242, 246 (including the ramp portion 247) and 244 and exits the sprayer insert 214 at the spray end 58. As the flowing water in the passage 244 flows over the passage 254, it creates a relatively low-pressure area. This reduced pressure causes fluid in the container 18 to be pushed by atmospheric pressure up the suction tube 96, through the passage 92 in the bottle seal 60, through the passage 130 to the slide 136. Rotation of the rotary valve 150 to the "COAT" position moves the slide 136 so that the passage 190 in the slider seal 142 is aligned with the passage 130. This permits the fluid being pushed up through the passage 130 to flow through the passage 190 and hence through the passages 210, 254 and into the passage 244 where it joins the fluid flowing through the passage 244 and mixes therewith. As fluid is drawn out of the container 18, air is drawn through the channels 200, 198, through the passages 132, 100 into the air space above the fluid in the container 18.

In this case the concentrated stain solution mixes with the water flowing through the passage 244 and is diluted thereby to a desired concentration. By controlling the size of the passage 254 and of the passages 242, 246 (including the ramp portion 247) and 244 the ratio for the dilution of the concentrated fluid from the container 18 with water from the garden hose (not shown) can be controlled. Furthermore, with the present invention the dilution ratio is independent of bulk fluid flow through the passage 242 and independent of the water pressure in the passage 242. In the case of the concentrated stain in container 18, a higher dilution ratio of between approximately 11 and 30 is useful. Since the dilution ratio is fixed by the dimensions of the passages 254, 242, 244 and 246 (including the ramp portion 247), it cannot be incorrectly set by the operator. The sprayer 10 can be moved back and forth so as to spray the diluted stain solution onto the wooden surface to be treated.

Another advantage of the sprayer 10 of the present invention is that since the dilution ratios are determined by fixed dimensions of the sprayer insert 214, the dilution ratio for the fluid path 216 can be the same or different from that of the fluid path 218. Thus, the present invention can provide two fixed, but different dilution ratios for the contents of the containers 16, 18. Accordingly, the different fluids in the containers 16, 18 each can have a different dilution ratio selected for that specific fluid and/or for specific applications of that fluid.

The embodiment of the present invention disclosed above is for systems with fluid flow rates less than 0.5 gallons per minute at dilution ratios of product to diluent of approximately 1:3–20. However, the present invention can also produce low dilution ratios at high diluting fluid flow rates; e.g., ratios of product to diluent of approximately 1:2–3 at flow rates greater than 1 gallon per minute; high dilution ratios at low diluting fluid flow rates; e.g., ratios of product to diluent of approximately 1:100–200 at flow rates less than 0.5 gallons per minute; and high dilution ratios at high diluting fluid flow rates; e.g., ratios of product to diluent of approximately 1:100–200 at flow rates greater than 1 gallon per minute. Other dilution ratios and diluting fluid flow rates can be achieved depending on the size of the passages employed in accordance with the present invention.

The precise mechanism by which the present invention is able to operate independent of conventional pressures in the inlet or to achieve low dilution rates at low flow rates, such as rates below 1 gallon per minute for typical residential uses, is not fully understood. However, it is believed that the present invention operates by deflecting fluid from the inlet channel up a ramp and into the ceiling of the outlet channel. This appears to produce a consistent waveform with a certain arcuate trajectory or angle of deflection in the outlet channel that generates a low-pressure area over the product inlet. This low-pressure area is where resident air is most likely displaced as the product enters the vortex of the carrier fluid within the outlet channel. This low pressure area can be "tuned" in a manner similar to the practice of manufacturing flue pipes in pipe organ manufacturing. Just as the tone of an organ's pipe sounding on constant pressure of air is immutable, once the outlet channel is full and the air therein is displaced, the ratio at which the fluid from the product inlet mixes with the carrier fluid in the outlet channel and the robustness with which that ratio and flow is maintained has not before been achieved by prior art dispensers.

Whereas, standard venturi-based systems rely upon outlet chambers having larger diameters than the inlet chambers to produce the pressure drop to drive the system, the present system does not utilize such a difference in diameters. At several points along the fluid path through the sprayer or dispenser of the present invention, a designer may effect ratio and flow changes beyond options available in standard venturi system. In addition to varying the diameter of the inlet and outlet channels, a designer can vary the offset of the two diameters, angle of the ramp, location and diameter of the product passage in relation to the ramp and angle of deflection, length of the outlet channel distal to the product inlet, the diameter of the outlet channel relative to its length and the degree to which the outlet channel flares or tapers near its terminus providing "harmonic" properties.

The present invention is applicable to fluids in general. While the present invention is especially intended to be used with liquids, it has also been used and tested with air. For example, when the present invention utilizes air as the diluting fluid and a liquid as the product fluid, the result can be a very fine aerosolization (such as a fog) of the liquid component. Properties fluids possess that wind traveling through an organ's pipe does not include the respective viscosities of the carrier and product, their respective surface tensions, both upon entry to the outlet passage and upon mixing, resistance to compression, and the relative friction of fluids as they interact with the texture and composition of the channel walls. All of these properties must be taken into account in the design.

As indicated above, while it is not understood in mathematical terms exactly how the sprayer operates, it is known that the above-referenced parameters can be changed to produce widely variable dilution ratios at relatively low flow rates. The ability to produce these dilution rates at low flow rates appears to be due to the fact that the aspiration rate is determined more by the velocity of the fluid and the characteristics of the resulting waveform than the fluid flow rate (in gallons per minute) of fluid through the system. In other words, the sprayer of the present invention allows a relatively small amount of fast moving fluid to pull a relatively high vacuum (in some cases, over 20 inches of Hg) at a relatively low flow rate, for example at flow rates as low as 0.2 gallons per minute, while achieving a dilution ratio as low as 1:3 (product to diluent). Depending on the dimensions of the passages, even lower flow rates can be achieved. For example, in the sprayer illustrated in the figures which is suitable for household applications, the dimensions of the fluid pathway 216 are given in Table 1 below and the effect of the change of those dimensions is shown. It is specifically contemplated that the dimensions of the fluid pathways 216, 218 can be adjusted depending on the particular application.

TABLE 1

| Test No. | Pressure (psi) | Flow (gpm) | Vacuum (psi) | Dilution Ratio ($H_2O$) | Dilution Ratio (Stain) | A | E | B |
|---|---|---|---|---|---|---|---|---|
| 1 | 40 | .28 | 6.5 | 6.2 | | 0.0600 | 0.0800 | 1.055 |
| 2 | 20 | 0.18 | 3.5 | 5.9 | | 0.0600 | 0.0800 | 1.055 |
| 3 | 40 | 0.36 | 7.5 | 5.7 | | 0.0600 | 0.0700 | 1.055 |
| 4 | 20 | 0.23 | 6 | 5.5 | | 0.0600 | 0.0700 | 1.055 |
| 5 | 40 | 0.30 | 6 | 6.6 | | 0.0700 | 0.0700 | 1.055 |
| 6 | 20 | 0.19 | ND | 7.9 | | 0.0700 | 0.0700 | 1.055 |
| 7 | 40 | 0.47 | 4 to 5 | 53.6 | | 0.0600 | 0.0600 | 1.055 |
| 8 | 40 | 0.48 | 3 | 15.6 | 23 | 0.0700 | 0.0600 | 0.7550 |
| 9 | 40 | 0.47 | 4 | 51.8 | 157 | 0.0750 | 0.0600 | 0.7550 |
| 10 | 40 | 0.46 | 1.5 | 21.7 | 36 | 0.0700 | 0.0600 | 0.7550 |
| 11 | 40 | 0.43 | 3.5 | 14 | 18 | 0.0700 | 0.0600 | 0.7550 |
| 12 | 40 | 0.48 | 2 | 23.5 | 30 | 0.0700 | 0.0600 | 0.7550 |
| 13 | 40 | 0.56 | 5 | 7.6 | 13 | 0.0700 | 0.0800 | 0.7550 |
| 14 | 40 | 0.50 | 1.5 | 28 | 39 | 0.0650 | 0.0600 | 0.7550 |
| 15 | 40 | 0.41 | 1.8 | 30.3 | 38 | 0.0600 | 0.0550 | 0.7550 |
| 16 | 40 | 0.82 | No Aspirira-tion | | | 0.0700 | 0.0700 | 0.7550 |

| Test No. | C | D | D-C | F | M | P (Product Orifice) | I = ((E-A)/2)-F | N (Calc.) |
|---|---|---|---|---|---|---|---|---|
| 1 | 1.112 | 1.252 | 0.1400 | 0.0450 | 0.1420 | 0.0400 | −0.0350 | −0.0020 |
| 2 | 1.112 | 1.252 | 0.1400 | 0.0450 | 0.1420 | 0.0400 | −0.0350 | −0.0020 |
| 3 | 1.110 | 1.252 | 0.1420 | 0.0350 | 0.1400 | 0.0400 | −0.0300 | 0.0020 |
| 4 | 1.110 | 1.252 | 0.1420 | 0.0350 | 0.1400 | 0.0400 | −0.0300 | 0.0020 |
| 5 | 1.139 | 1.256 | 0.1170 | 0.0350 | 0.1110 | 0.0400 | −0.0350 | 0.0060 |

TABLE 1-continued

| | | | | | | | | |
|---|---|---|---|---|---|---|---|---|
| 6 | 1.139 | 1.256 | 0.1170 | 0.0350 | 0.1110 | 0.0400 | −0.0350 | 0.0060 |
| 7 | 1.128 | 1.253 | 0.1250 | 0.0200 | 0.1340 | 0.0400 | −0.0200 | −0.0090 |
| 8 | 0.8350 | 0.9570 | 0.1220 | 0.0300 | 0.1370 | 0.0400 | −0.0350 | −0.0150 |
| 9 | 0.8330 | 0.9570 | 0.1240 | 0.0230 | 0.1400 | 0.0400 | −0.0305 | −0.0160 |
| 10 | 0.8340 | 0.9580 | 0.1240 | 0.0300 | 0.1410 | 0.0400 | −0.0350 | −0.0170 |
| 11 | 0.8430 | 0.9580 | 0.1150 | 0.0300 | 0.1300 | 0.0400 | −0.0350 | −0.0150 |
| 12 | 0.8630 | 0.9560 | 0.0930 | 0.0300 | 0.1100 | 0.0400 | −0.0350 | −0.0170 |
| 13 | 0.7950 | 0.9570 | 0.1620 | 0.0250 | 0.1500 | 0.0400 | −0.0200 | 0.0120 |
| 14 | 0.8430 | 0.9560 | 0.1130 | 0.0175 | 0.1320 | 0.0400 | −0.0200 | −0.0190 |
| 15 | 0.8430 | 0.9570 | 0.1140 | 0.0175 | 0.1320 | 0.0400 | −0.0200 | −0.0180 |
| 16 | 0.8330 | 0.9580 | 0.1220 | 0.0100 | 0.1280 | 0.0400 | −0.0100 | −0.0060 |

Figure 32:
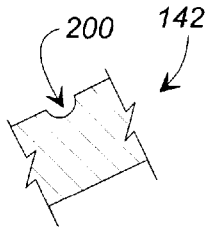
FIG. 32 is a partial side cross-sectional view of the slider seal shown in FIG. 20 taken along the line 32—32.
Figure 25:
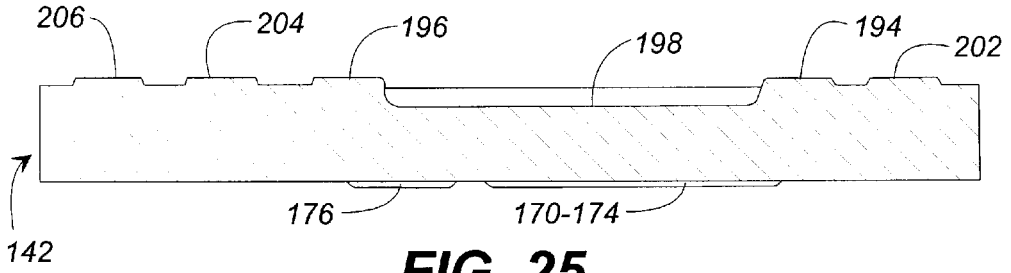
FIG. 25 is an end cross-sectional view of the slider seal shown in FIG. 20 taken along the line 25—25.
Figure 31:
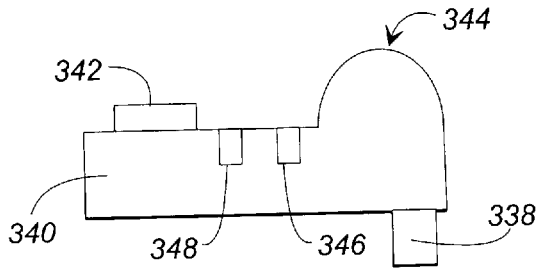
FIG. 31 is a detail view of the mixing chamber shown in FIG. 30.
Figure 30:
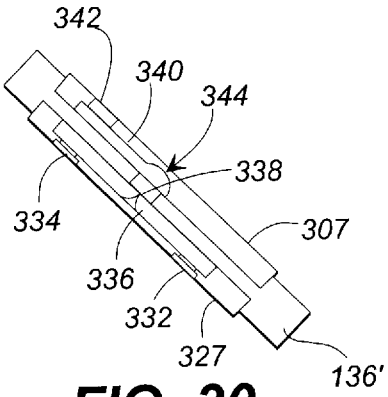
FIG. 30 is an end cross-sectional view of the slider seal and slide shown in FIG. 27 taken along the line 30—30.
Figure 27:
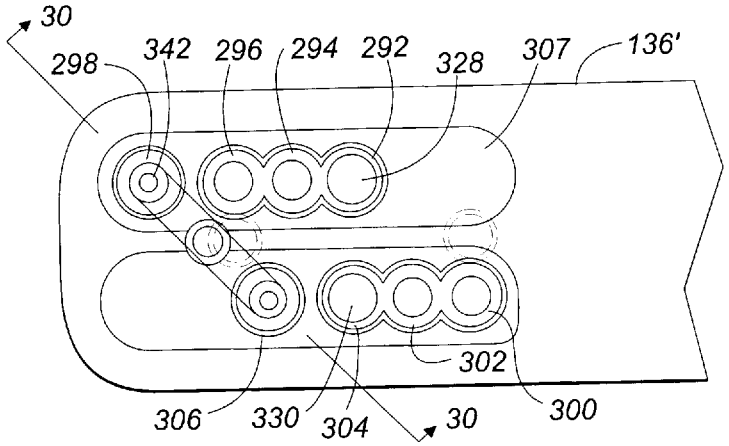
FIG. 27 is a partial top view of an alternate disclosed embodiment of a slider seal and slide for use with the sprayer shown in FIG. 1.
Figure 28:
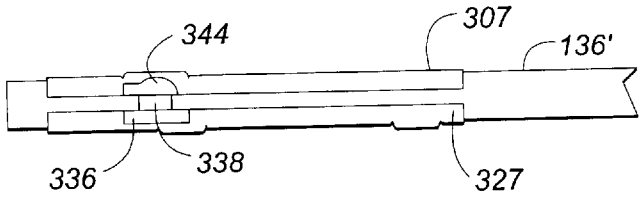
FIG. 28 is a side view of the slider seal and slide shown in FIG. 27.
Figure 29:
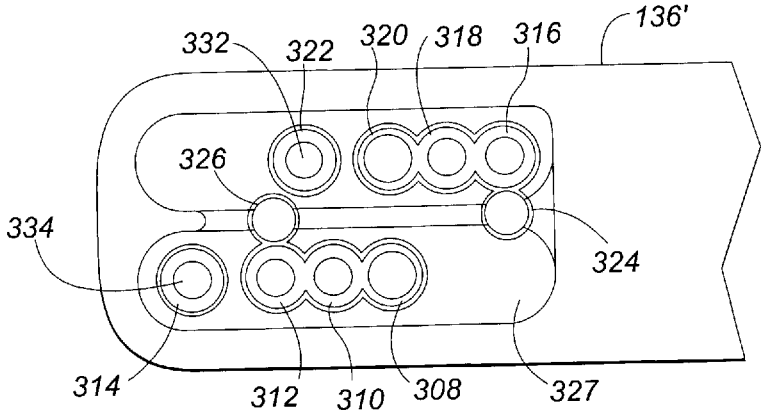
FIG. 29 is a bottom view of the slider seal and slide shown in FIG. 27.
Figure 33:
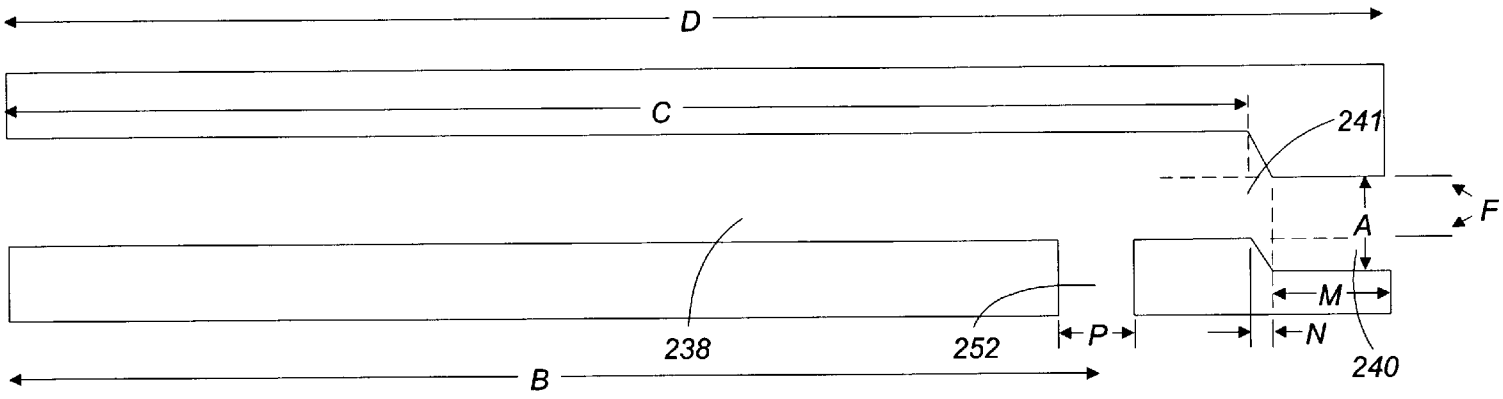
FIG. 33 is a detail side schematic view of one of the fluid paths shown in FIGS. 13 and 15.
Figure 34:
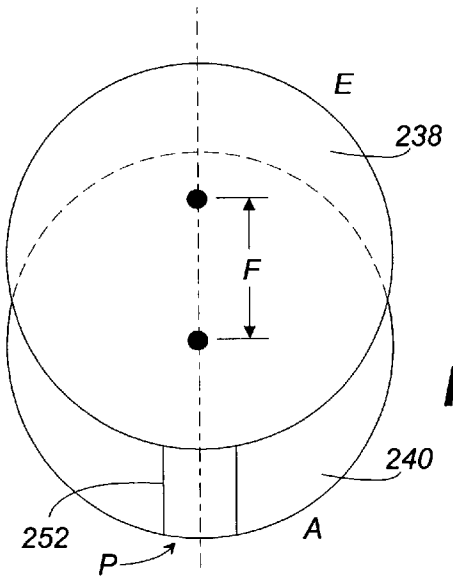
FIG. 34 is a detail front schematic view of the fluid path shown in FIG. 32.

The location of each of the variable A–F, I, M, N and P shown in Table 1 above are shown in FIGS. 32 and 33. A11 dimensions are in inches.

The consistent waveform generated in the outlet tube under some conditions can produce an audible tone, at high frequencies, or a pulsating sound, at low frequencies. Counterboring the front portion of each outlet tube 238, 244 to increase the diameter or length thereof changes the observed frequency, thereby permitting the "tuning" or refining of the dilution ratio. Without counterboring, the fluid waveform in the outlet tube ensures wall contact of the outlet stream, and, therefore, prevents air leakage back into the outlet stream from the front of the sprayer. By counterboring the outlet tube to a certain depth, air can be introduced in a controlled manner to the fluid stream after combination with the aspirated product from the one of the containers 16, 18. In the case of a surfactant or cleaner, the introduction of air into the outlet stream produces a foaming action that is desirable in some products.

A particularly valuable feature of the present invention is its ability to produce consistent dilution ratios over a wide pressure range. The design of the present invention eliminates the typical pressure dependence of dilution rate. This advantage has ramifications in many applications. The ability to generate a relatively high vacuum at relatively very low flow rates has implications in the medical field, for example, improving the efficiency of dialysis or other types of ion exchange or particle filtration or other applications where subsequent recovery or reconstitution of ion balance is necessary, where pressurization through the use of servomotors or peristaltic pumps is impractical, where volumetric means of mixing concentrate; e. g., beverage syrup with diluent; e.g., carbonated water, in a batch process rather than a continuous one results in significant variance from nominal concentration, and in materials transport or water treatment. The amount of waste fluid generated by the present invention is lower than that produced by prior art sprayers and the sprayer operates at higher efficiencies than prior art sprayers.

Figure 26:
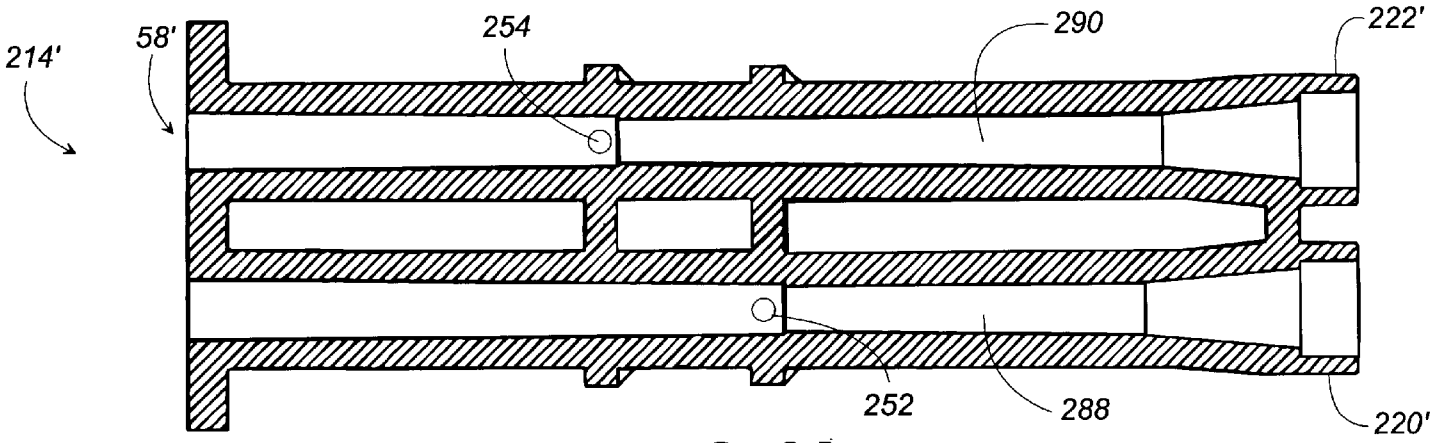
FIG. 26 is top cross-sectional view of an alternate disclosed embodiment of a sprayer insert for use with the sprayer shown in FIG. 1.

With reference to FIG. 26, it can be seen that there is shown an alternate disclosed embodiment of the sprayer insert 214' of the present invention. The sprayer insert 214' defines two passages 288, 290 that extend from the couplings 220', 222' to the spray end 58'. These two passages 288, 290 have the same cross-sectional area throughout their length. Furthermore, although the present invention has been shown as using an interchangeable sprayer insert 214 that defines the fluid paths 216, 218, it is specifically contemplated that the fluid paths can be defined by the sprayer housing 12 so as to form an integral portion of the sprayer 10; i.e., without the sprayer insert 214. The sprayer insert 214 may also be manufactured by a variety of methods as either a one-piece or a multi-part insert depending upon manufacturing and assembly considerations.

With reference to FIGS. 27–31, it can be seen that there is shown an alternate disclosed embodiment of the slider seal 142. The slider seal 142' is made from an elastomeric material that is flexible and resilient, such as natural or synthetic rubber or polymeric materials, such as polyurethane, silicone rubber or thermoplastic elastomers. The slider seal 142' includes a plurality of raised portions 292–306 on the top portion 307 of the slider seal and a plurality of corresponding raised portions 308–322 and a pair of centrally aligned raised portions 324, 326 on the bottom portion 327 of the slider seal for sliding and sealing engagement with the top surface 186 and bottom surface 188, respectively, of the slide valve chamber 134. The slider seal 142' further defines a pair of openings 328, 330 that extend from one side of the slider seal 142' to the other so that fluid can pass therethrough. The slider seal 142' additionally defines a pair of openings 332, 334 concentric with the raised portions 322, 314, respectively. The openings 332, 334 are in fluid communication with a chamber 336 defined between the bottom portion 327 of the slider seal 142' and the slide 136' and extending from the opening 332 to the opening 334. The slide 136' defines an opening 338 aligned and in fluid communication with the chamber 336. Defined between the top portion 307 of the slider seal 142' and the slide 136' is a chamber 340 aligned and in fluid communication with the opening 338. The chamber 340 extends from the opening 338 to an opening 342 defined by the top portion 307 of the slider seal 142' and is aligned and in fluid communication therewith. The chamber 340 includes a hemispherically-shaped portion 344 aligned with the opening 338. Extending downwardly from the top portion 307 of the slider seal 142' into the chamber 340 intermediate the openings 338, 342 are fingers 346, 348.

Operation of the slider seal 142' will now be considered. When the knob 256 is in the "OFF," "COAT" or "CLEAN" position, the sprayer 10 employing the slider seal 142' will operate as described above. However, when the knob 256 is in the "RINSE" position, the slider seal 142' performs a different function. When the knob 256 is in the "RINSE" position, the raised portions 298, 314 are aligned with the passages 210, 130, respectively, and the raised portions 306, 322 are aligned with the passages 126, 208. Fluid is pushed up both the passages 126, 130 from the containers 16, 18. Fluid from the passages 126, 130 then flows through the openings 332, 334 into the chamber 336 and hence through the opening 338 into the chamber 340. In the chamber 340, the fluid flows from the opening 338 toward the opening 342. The hemispherical portion 338 and the fingers 346, 348 promote a turbulent flow of the fluid through the chamber 340, and, thus, promote mixing of the two fluids from the containers 16, 18. The mixed fluids in the chamber 340 exit through the opening 342 and flow through the passage 254 to the passage 244 in the manner as described previously.

The embodiment of the present invention disclosed above illustrates use of the sprayer/aspirator device with a motive and diluting fluid under pressure at the hose coupling and open to the atmosphere at the sprayer outlet. It is also specifically intended that the present invention can be used to introduce precisely metered amounts of material into a closed motive and diluting fluid system where a pressure differential exists between the upstream and downstream portions of the diluting fluid. The present invention may include only those aspects of the sprayer/aspirator device shown above which determine ratio and flow rate; i.e., the flow paths of the insert. Furthermore, the sprayer disclosed above utilizes an insert containing the fluid flow paths that determine flow rate and dilution ratio. However, it is specifically contemplated that the fluid paths housed in the insert can be molded within the sprayer body itself, without the use of an insert.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. An apparatus comprising:

a housing having first and second inlets and a first outlet;

the first inlet supplying a first fluid to the apparatus;

the second inlet supplying a second fluid to the apparatus; and the housing defining a passage in fluid communication with the first and second inlets and the first outlet, the passage including an upstream portion and a downstream portion, the second inlet being in communication with the downstream portion, said upstream portion intersecting said downstream portion such that the longitudinal axis of said downstream portion is at an acute angle with respect to the longitudinal axis of said upstream portion, said downstream portion having a substantially uniform cross-sectional area adjacent said second inlet and the downstream portion having substantially the same cross-sectional area as the upstream portion so that second fluid is siphoned into the downstream portion and mixed with first fluid supplied through the upstream portion to provide a fluid mixture, the fluid mixture being conveyed in the downstream portion to the first outlet.

2. An apparatus comprising:

a housing, said housing defining a first fluid passage from an inlet to an outlet;

said first fluid passage including a first portion and a second portion, said first portion intersecting said second portion at an acute angle with respect to the longitudinal axes of said first and second portions; and said housing further defining a second fluid passage from an inlet to an outlet, said second fluid passage intersecting said second portion of said first fluid passage adjacent said first portion, said second portion having a substantially uniform cross-sectional area adjacent said outlet of said second fluid passage such that fluid flowing through said first passage draws fluid in said second passage into said first passage.

3. The apparatus of claim 2, wherein said angle between said first and second portions of said passage is such that a consistent waveform is produced in said fluid flowing through said second portion of said passage.

4. The apparatus of claim 2, wherein said second portion of said passage is sized and shaped such that a consistent waveform is produced in said fluid flowing through said second portion of said passage.

5. An apparatus comprising:

a housing, said housing defining a first fluid passage from an inlet to an outlet;

said first fluid passage including a first portion and a second portion, said first portion intersecting said second portion at an acute angle with respect to the longitudinal axes of said first and second portions;

said housing further defining a second fluid passage from an inlet to an outlet, said second fluid passage intersecting said second portion of said first fluid passage adjacent said first portion, said second portion having a substantially uniform cross-sectional area adjacent said outlet of said second passage such that fluid flowing through said first passage draws fluid in said second passage into said second portion of said first passage; and said first and second portions of said passage being arranged such that the ratio of fluid flowing through said second passage and fluid flowing through said first passage is as low as approximately 1:3.

6. The apparatus of claim 5, wherein said fluid flows through said passage at a rate as low as approximately 0.2 gallons per minute and as high as 4 gallons per minute.

7. A method comprising causing a first fluid to flow through a first passage that intersects a second passage at an acute angle with respect to the longitudinal axes of said first and second passages, said first fluid drawing a second fluid into said second passage through a third passage that intersects said second passage, said second and third passages being adapted such that said first and second fluids produce a consistent waveform in a portion of said first passage downstream of said intersection with said second passage, said second passage having a substantially uniform cross-sectional area adjacent said intersection of said second passage.

8. An apparatus comprising:

a housing having first and second inlets and a first outlet;

the first inlet supplying a first fluid to the apparatus;

the second inlet supplying a second fluid to the apparatus; and the housing defining a passage in fluid communication with the first and second inlets and the first outlet, the passage including an upstream portion, a connecting portion and a downstream portion, the connecting portion intersecting the downstream portion at an acute angle with respect to the longitudinal axes of said connecting portion and said downstream portion, said downstream portion having a substantially uniform cross-sectional area adjacent said intersection of said connecting portion and the downstream portion having a smaller cross-sectional area than the upstream portion, the second inlet being in communication with the downstream portion, so that second fluid is siphoned into the downstream portion and mixed with first fluid supplied through the upstream portion to provide a fluid mixture, the fluid mixture being conveyed in the downstream portion to the first outlet.

9. The apparatus of claim 8, wherein the first fluid is water and the second fluid is a concentrated product, whereby the concentrated product is diluted with water in the passage.

10. The apparatus of claim 8, wherein the second fluid is a drug.

11. The apparatus of claim 8, wherein the second fluid is a solution, suspension or emulsion of a drug.

12. The apparatus of claim 8, wherein said angle between said connecting portion and said downstream portion of said passage is such that a consistent waveform is produced in said fluid flowing through said downstream portion of said passage.

13. The apparatus of claim 8, wherein said downstream portion and connecting portion of said passage are sized and shaped such that a consistent waveform is produced in said fluid flowing through said downstream portion of said passage.

14. A method comprising causing a first fluid to flow through a first passage, said first fluid drawing a second fluid into said first passage through a second passage that intersects said first passage, said first passage having a first portion and a second portion, said first portion intersecting said second portion at an acute angle with respect to the longitudinal axes of said first and second portions and said second portion having a substantially uniform cross-sectional area adjacent said intersection of said second passage.

15. The method of claim 14, wherein said second fluid is a drug.

16. The method of claim 14, wherein said second fluid is a suspension or emulsion of a drug.

17. The method of claim 14, wherein said second fluid is a solution, suspension or emulsion of a mineral.

18. The method of claim 14, wherein said second fluid includes a blood product.

19. The method of claim 14, wherein said second fluid includes a pesticide.

20. The method of claim 14, wherein said second fluid includes a herbicide.

21. The method of claim 14, wherein said second fluid includes an insecticide.

22. The method of claim 14, wherein said second fluid includes a detergent or surfactant.

23. The method of claim 14, wherein said second fluid includes a wax.

24. The method of claim 14, wherein said second fluid includes a cleaner.

25. The method of claim 14, wherein said second fluid includes a disinfectant.

26. The method of claim 14, wherein said second fluid includes a colorant.

27. The method of claim 14, wherein said second fluid includes an adhesive.

28. The method of claim 14, wherein said second fluid includes a sealer.

29. The method of claim 14, wherein said second fluid includes a film-forming composition.

30. The method of claim 14, wherein said second fluid includes a sheen aid.

31. The method of claim 14, wherein said second fluid includes a fertilizer.

32. The method of claim 14, wherein said second fluid includes a plant growth regulator.

33. The method of claim 14, wherein said second fluid includes an electrolyte.

34. The method of claim 14, wherein said second fluid includes a flavorant.

35. The method of claim 14, wherein said second fluid includes a beverage syrup.

36. The method of claim 14, wherein said second fluid is heparin.

* * * * *